US007584730B2

(12) United States Patent
Fujita et al.

(10) Patent No.: US 7,584,730 B2
(45) **Date of Patent: *Sep. 8, 2009**

(54) VALVE TRAIN DEVICE FOR ENGINE

(75) Inventors: Hideo Fujita, Shizuoka-ken (JP); Koichi Hatamura, Hiroshima (JP)

(73) Assignee: Yamaha Hatsudoki Kabushiki Kaisha, Shizuoka-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/668,401

(22) Filed: Jan. 29, 2007

(65) Prior Publication Data

US 2007/0204820 A1 Sep. 6, 2007

Related U.S. Application Data

(63) Continuation of application No. 11/263,573, filed as application No. PCT/JP2004/006426 on May 6, 2004, now Pat. No. 7,168,403.

(30) Foreign Application Priority Data

May 1, 2003 (JP) ..... 2003-126257
Aug. 28, 2003 (JP) ..... 2003-304932

(51) Int. Cl.
*F01L 1/34* (2006.01)

(52) U.S. Cl. ..... 123/90.16; 123/90.15

(58) Field of Classification Search ..... 123/90.15, 123/90.16, 90.39, 90.31
See application file for complete search history.

(56) References Cited

U.S. PATENT DOCUMENTS 4,424,790 A 1/1984 Curtil
4,572,118 A 2/1986 Baguena
4,714,057 A 12/1987 Wichart
5,018,487 A 5/1991 Shinkai
5,189,998 A 3/1993 Hara (Continued)

FOREIGN PATENT DOCUMENTS

DE 19708484 9/1998

(Continued)

OTHER PUBLICATIONS

International Search Report for Application No. PCT/JP03/06202.

(Continued)

*Primary Examiner*—Zelalem Eshete
(74) *Attorney, Agent, or Firm*—Knobbe, Martens, Olson & Bear, LLP.

(57) ABSTRACT

A valve train device for an engine for driving a valve which opens and closes a valve opening of a combustion chamber comprises: a valve drive device comprising a drive member and driving force transmission mechanism. The drive force transmission mechanism is configured to transmit a driving force from the drive member to the valve. The drive force transmission mechanism comprises a transmission portion configured to transmit the driving force from the drive member to the valve and a variable portion configured to continuously change a state of the transmission portion to thereby continuously change an opening duration of the valve or the amount of valve lift. At least part of the variable portion is positioned within in the transmission portion.

13 Claims, 15 Drawing Sheets

U.S. PATENT DOCUMENTS

| | | | |
|---|---|---|---|
| 5,373,818 | A | 12/1994 | Unger |
| 5,601,056 | A | 2/1997 | Kuhn et al. |
| 6,135,075 | A | 10/2000 | Boertje et al. |
| 6,138,636 | A | 10/2000 | Kohno et al. |
| 6,386,162 | B2 | 5/2002 | Himsel |
| 6,422,187 | B2 | 7/2002 | Fischer et al. |
| 6,425,357 | B2 | 7/2002 | Shimizu et al. |
| 6,431,129 | B1 | 8/2002 | Hammoud |
| 6,481,399 | B1 | 11/2002 | Morrn |
| 6,659,053 | B1 | 12/2003 | Cecur |
| 6,688,275 | B2 | 2/2004 | Shindou et al. |
| 6,907,852 | B2 | 6/2005 | Schleusener et al. |
| 7,069,890 | B2 | 7/2006 | Fujita et al. |
| 7,096,835 | B2 | 8/2006 | Fujita et al. |
| 7,168,403 | B2 | 1/2007 | Fujita et al. |
| 2001/0052329 | A1 | 12/2001 | Himsel |
| 2003/0116124 | A1 | 6/2003 | Lawrence |
| 2005/0126526 | A1 | 6/2005 | Fujita et al. |
| 2005/0229882 | A1 | 10/2005 | Fujita et al. |
| 2006/0075982 | A1 | 4/2006 | Fujita et al. |
| 2006/0102120 | A1 | 5/2006 | Fujita et al. |
| 2006/0107915 | A1 | 5/2006 | Fujita et al. |
| 2006/0130459 | A1 | 6/2006 | Warner |
| 2006/0207532 | A1 | 9/2006 | Fujita et al. |
| 2006/0207533 | A1 | 9/2006 | Fujita et al. |
| 2006/0243233 | A1 | 11/2006 | Fujita et al. |
| 2007/0028876 | A1 | 2/2007 | Fujita |

FOREIGN PATENT DOCUMENTS

| | | | |
|---|---|---|---|
| DE | 10123186 | | 11/2002 |
| JP | 62-9864 | | 7/1988 |
| JP | 63-179257 | | 7/1988 |
| JP | 62-255538 | | 11/1988 |
| JP | 63-309707 | | 12/1988 |
| JP | 02-241916 | | 9/1990 |
| JP | 06-017626 | | 1/1994 |
| JP | 06-093816 | | 5/1994 |
| JP | 06-272525 | | 9/1994 |
| JP | 06-307219 | | 11/1994 |
| JP | 07-063023 | | 3/1995 |
| JP | 07-133709 | | 5/1995 |
| JP | 07-293216 | | 7/1995 |
| JP | 07-293216 | | 11/1995 |
| JP | 09-268907 | | 10/1997 |
| JP | 61-99707 | | 1/1998 |
| JP | 11-036833 | | 9/1999 |
| JP | 2000-213320 | | 8/2000 |
| JP | 2001-263015 | | 9/2001 |
| JP | 2002-371816 | | 12/2002 |
| JP | 2003-106123 | | 4/2003 |
| JP | 2003-148116 | | 5/2003 |
| JP | 2003-201814 | | 7/2003 |
| JP | 2003-239713 | | 8/2003 |
| JP | 2004-006428 | | 11/2004 |
| JP | 2004-012191 | | 3/2005 |
| JP | 2004-012192 | | 3/2005 |
| WO | WO 02/092972 | | 11/2002 |
| WO | WO 03/098012 | A1 | 11/2003 |
| WO | WO 2004/097186 | A1 | 11/2004 |
| WO | WO 2005/019607 | A1 | 3/2005 |
| WO | WO 2005/019609 | A1 | 3/2005 |

OTHER PUBLICATIONS

International Search Report for Application No. PCT/JP03/06236.

International Search Report for Application No. PCT/JP2004/006428.

International Search Report for Application No. PCT/JP2004/012191.

International Search Report for Application No. PCT/JP2004/012192.

International Search Report for Application No. PCT/JP2004/012193.

Anontaphan, Thitiphol. A study of a mechanical continuous rocker arm (VRA), SAE technical paper series 2003-01-0022, 2003 SAE World Congress Detroit, Michigan, Mar. 3-6, 2003.

VALVE TRAIN DEVICE FOR ENGINE

PRIORITY INFORMATION

This application is continuation of PCT Application No. PCT/JP2004/006426, filed on May 6, 2004, which claims priority under 35 U.S.C. § 119 to Japanese Patent Application No. 2003-304932, filed on Aug. 28, 2003 and Japanese Patent Application No. 2003-126257, filed on May 1, 2003, the entire contents of these applications are expressly incorporated by reference herein.

BACKGROUND OF THE INVENTION

1. Field of the Invention

This invention relates to a valve train device for an engine and, more particularly, to a valve train device which can continuously change valve opening duration and/or the amount of valve lift.

2. Description of the Related Art

It is known in the art how to provide engines with a valve train device that is capable of continuously changing intake valve opening duration and/or the amount of valve lift. An example of such a valve train device comprises a camshaft, which drives an intake valve to open and close through a rocker arm, a swing arm that is driven to swing by the camshaft and a control arm that is interposed between a swing cam surface of the swing arm and a rocker-side depressed surface of the rocker arm. The valve opening duration and the amount of valve lift is continuously varied by continuously changing a point of the control arm that comes into contact with the swing cam surface and a point of the control arm that comes into contact with the depressed surface of the rocker arm (See e.g., JP-A-Sho 59-500002).

SUMMARY OF THE INVENTION

In the conventional valve train device described above, the device includes the rocker arm, the swing arm and the control arm. The contact point between the control arm and the swing cam surface, as well as the contact point between the control arm and the rocker-side depressed surface is displaced to vary the valve lift and valve lift duration. While effective, there is a concern that the size of the overall device might increase depending on the features of the components determined to rigidly secure the device and on the layout of such components.

In view of the foregoing, it is, therefore, an object of an embodiment of the present invention to provide a valve train device for an engine capable of rigidly securing the components as well a providing a compact arrangement.

Accordingly, one embodiment of the present invention comprises a valve train device for an engine for driving a valve which opens and closes a valve opening of a combustion chamber. The device comprises a valve drive device and drive force transmission mechanism. The drive force transmission mechanism is configured to transmit a driving force from the drive member to the valve. The drive force transmission mechanism comprises a transmission portion configured to transmit the driving force from the drive member to the valve and a variable portion configured to continuously change a state of the transmission portion to thereby continuously change an opening duration of the valve or the amount of valve lift. At least part of the variable portion is positioned within in the transmission portion.

For purposes of summarizing the invention, certain aspects, advantages and novel features of the invention have been described herein. It is to be understood that not necessarily all such advantages may be achieved in accordance with any particular embodiment of the invention. Thus, the invention may be embodied or carried out in a manner that achieves or optimizes one advantage or group of advantages as taught herein without necessarily achieving other advantages as may be taught or suggested herein

BRIEF DESCRIPTION OF THE DRAWINGS

A general architecture that implements various features of specific embodiments of the invention will now be described with reference to the drawings. The drawings and the associated descriptions are provided to illustrate embodiments of the invention and not to limit the scope of the invention.

DETAILED DESCRIPTION OF THE PREFERRED EMBODIMENT

Figure 1:
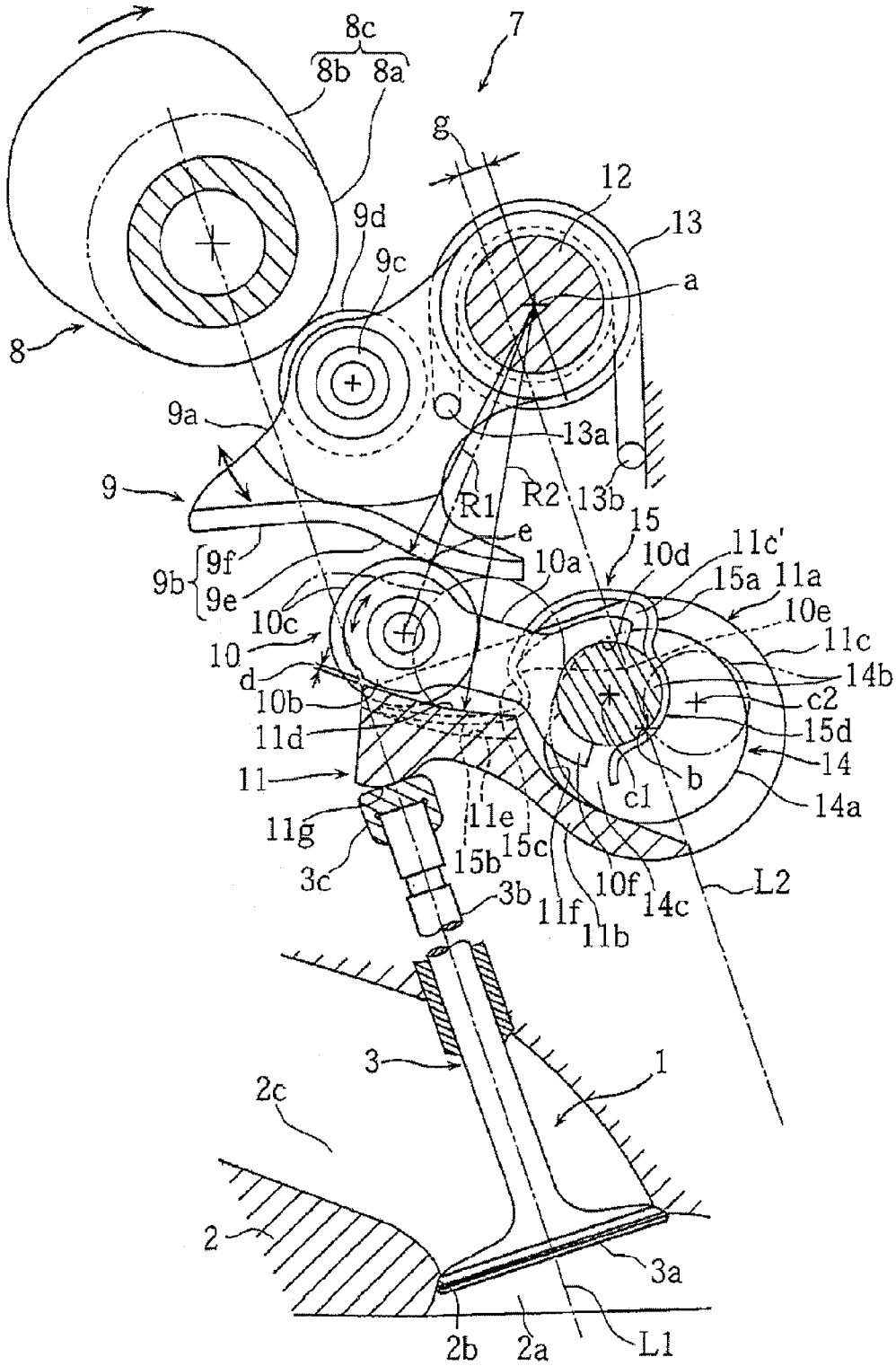
FIG. 1 is a sectional side view of a valve train device for an engine according to a first embodiment of the present invention.
Figure 2:
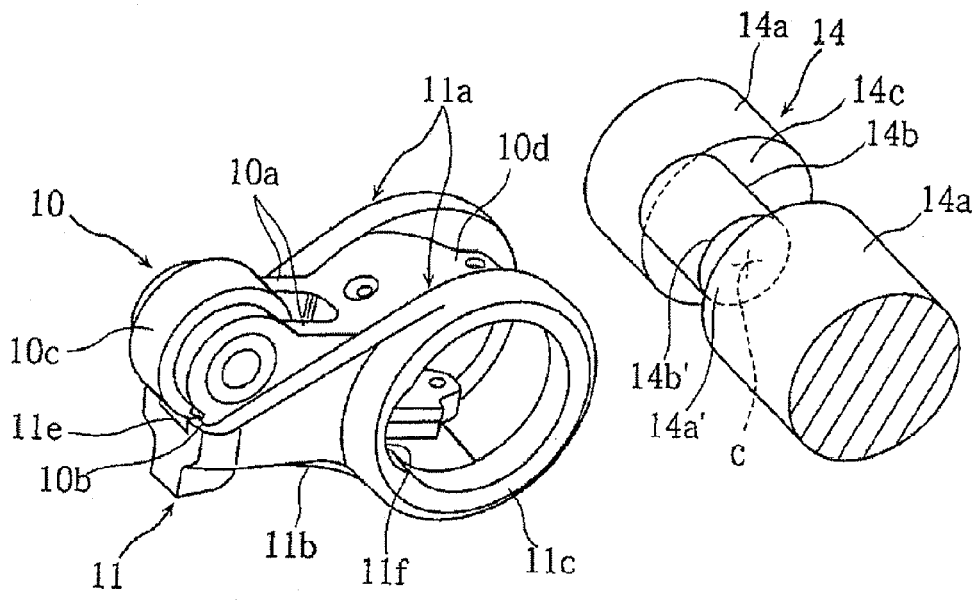
FIG. 2 is an exploded perspective view of a control arm, rocker arm and rocker shaft of the first embodiment.
Figure 3:
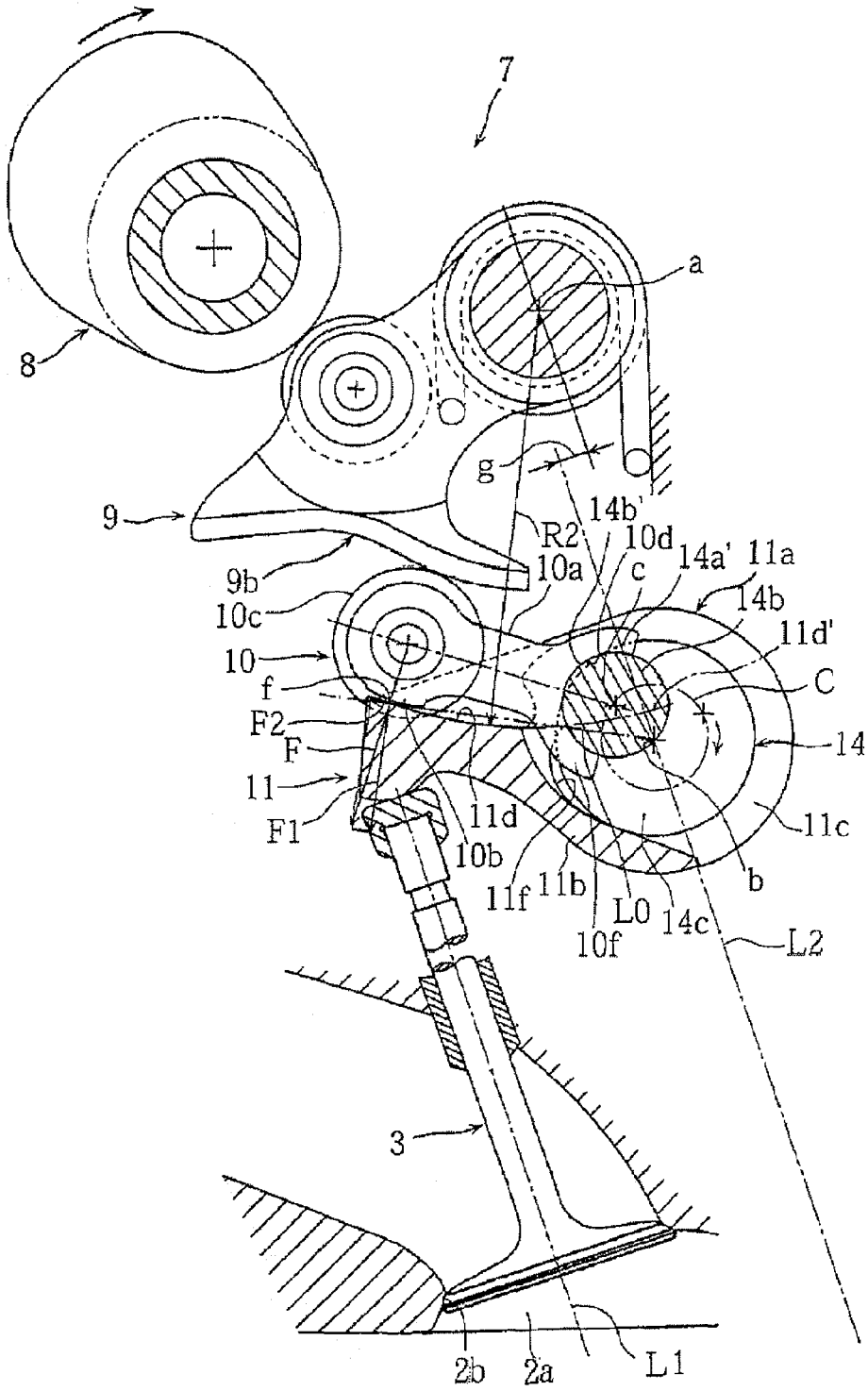
FIG. 3 is a sectional side view for describing the forces incurred in the first embodiment.

An embodiment of the present invention will be described hereinafter with reference to the attached drawings. FIGS. 1 to 3 describe a first embodiment of the invention. FIG. 1 is a sectional side view of a valve train device according to this embodiment. FIG. 2 is a perspective view of several parts of the valve train device. FIG. 3 is a view for describing transfer efficiency of a force F in this embodiment.

In FIG. 1, reference numeral 1 denotes a valve device for opening and closing valve openings formed in a combustion chamber. As is know, an engine can be provided with two intake and exhaust valves. However, in this Figure, only a portion of an intake valve side is shown. A combustion recess 2*a* is provided on the mating face of a cylinder head 2 of the engine with the cylinder body. The combustion recess 2*a* forms a top ceiling of a combustion chamber. The combustion recess 2*a* includes left and right intake valve openings 2*b*. Each intake valve opening 2*b* is merged with a bifurcated intake port 2*c* and led to an external connection opening of an engine wall. Each intake valve opening 2*b* is opened and closed through a valve head 3*a* of an intake valve 3. The intake valve 3 is constantly urged with a valve spring or biasing member (not shown) in closing direction.

In the embodiments described below, reference will be made to the intake valve 3 and intake valve device 1. However, it should be appreciated that certain features and aspects of these embodiments may also be applied to an exhaust device and exhaust valve. It should also be appreciated that various features, aspects and advantages of the present invent may be used with engines having more than one or more intake valves and/or exhaust valves, and any of a variety of configurations including a variety of numbers of cylinders and cylinder arrangements (V, W, opposing, etc.).

A valve train device 7 is disposed generally above the intake valve 3. The valve train device 7 is configured to drive the intake valve 3 to open and close by transmitting a driving force from an intake camshaft (driving member) 8 to the intake valve 3 via a driving force transmission mechanism. The driving force transmission mechanism includes a transmitting portion for transmitting the driving force from the intake camshaft 8 to the intake valve 3, and a variable portion for continuously changing the state of the transmitting portion transmitting the driving force, thereby continuously changing an opening duration of the valve 3 and the amount of valve lift.

More specifically, in the illustrated embodiment, the driving force transmission mechanism is configured such that: the intake camshaft 8 causes a first swing arm 9 to swing or pivot, the swing arm 9 causes a first rocker arm 11 to swing pivot through a first control arm 10, and the swing or pivoting motion of the first rocker arm 11 causes the intake valve 3 to proceed and retract in the axial direction, and thus the intake valve opening 2*b* is opened and closed.

Causing the first control arm 10 to proceed and retract can continuously vary a contact point between the first control arm 10 and the first swing arm 9 and a contact point between the first control arm 10 and the first rocker arm 11, thereby continuously changing the opening duration of the intake valve 3 and the amount of valve lift.

The intake camshaft 8 is arranged in parallel with a crankshaft (not shown) and supported to be rotatable and immobile in the direction perpendicular to the intake camshaft and in the axial direction through a cam journal portion formed on the cylinder head 2 and a cam cap provided on an upper mating face of the journal portion. The intake camshaft 8 is formed with a single cam nose 8*c* common to the left and right intake valves, including a base circle portion 8*a* having a uniform diameter, and a lift portion 8*b* having a specified cam profile. Each cylinder is preferably provided with a single cam nose.

The first swing arm 9 includes a pair of left and right swing arm portions 9*a*, 9*a*, a swing cam surface (i.e., a first swing cam surface) 9*b*, a roller shaft 9*c*, and a swing roller 9*d*. The pair of swing arm portions 9*a*, 9*a* are supported for free swinging or pivotal movement with a swing support shaft 12, which is preferably arranged in parallel with the intake camshaft 8 and is immobile in the direction perpendicular to the swing shaft and in the axial direction. In the illustrated embodiment, the swing cam surface 9*b* is formed integrally with a coupling portion for coupling the distal ends (lower ends) of the swing arm portions 9*a*. The roller shaft 9*c* is arranged in parallel with the swing shaft 12 and passes through the midsection between the left and right swing arm portions 9*a*, 9*a*. The swing roller 9*d* is rotatably supported with the roller shaft 9*c* and located between the left and right swing arm portions 9*a*, 9*a*.

The proximal ends (upper ends) of the swing arm portions 9*a* are supported with the swing support shaft 12 for free swinging or pivoting movement. The swing support shaft 12 is provided with a pair of left and right balance springs 13 as coil springs. Each balance spring 13 has an end 13*a* retained to a position of the swing arm portion 9*a* between the swing shaft 12 and the roller shaft 9*c*, and the other end 13*b* of each balance spring is retained to the cylinder head 2. The balance spring 13 urges the first swing arm 9 clockwise of FIG. 1 such that the swing roller 9*d* of the first swing arm 9 comes in rotational contact with the cam nose 8*c* of the intake camshaft 8 without a gap, thereby preventing the first swing arm 9 from moving away from the camshaft 8 at high engine speed. This avoids abnormal behavior of the swing member 9.

The swing cam surface 9*b* is generally in the shape of a plate having a curved surface in a base circle portion 9*e* and a lift portion 9*f* which are connected to each other continuously. The first swing arm 9 is provided so that the base circle portion 9*e* is positioned nearer to a rocker shaft 14 and the lift portion 9*f* is positioned opposite the rocker arm support shaft 14. The base circle portion 9*e* has an arcuate shape of a radius R1 around the axial center of the swing shaft 12 as the center of swing (a). Thus, while the base circle portion 9*e* depresses the roller 10*c*, the intake valve 3 is at a fully closed position and is not lifted with an increase of the swing angle of the first swing arm 9.

Meanwhile, the lift portion 9*f* lifts the intake valve 3 by a larger amount as the lift portion 8*b* of the intake camshaft 8, at the portion close to its top depresses the swing roller 9*d*, that is, as the swing angle of the first swing arm 9 increases. In this embodiment, the lift portion 9*f* includes a ramp zone which gives a constant speed, an acceleration zone which gives a varied speed, and a lift zone which gives generally a constant speed.

The rocker arm support shaft 14 includes a large-diameter portion 14*a* and an eccentric pin (eccentric shaft) 14*b* having a smaller diameter than the one for the large-diameter portion. The eccentric pin 14*b* is provided on an axial midsection of the large-diameter portion 14*a*, while being offset from an axial center (b) of the rocker shaft 14 toward the outer side in the radial direction. The large-diameter portion 14*a* is rotatably supported with the cylinder head 2. As shown in FIG. 2, the eccentric pin 14*b* has an axial center (c) positioned such that part of the outer surface 14*b*' protrudes outward in the radial direction from an outer surface 14*a*' of the larger-diameter portion 14*a*. To the rocker shaft 14 is connected a rocker shaft driving mechanism (not shown) for controlling an angular position of the rocker shaft 14 according to an engine load (throttle opening) and engine speed.

The first rocker arm 11 is formed with left and right rocker arm portions 11*a*, 11*a*, a rocker coupling portion 11*b*, and ring-shaped bearing portions 11*c*, 11*c*. Lower-half portions on the distal end side of the left and right rocker arm portions 11*a*, 11*a* are coupled integrally with the rocker coupling portion 11*b*. The ring-shaped bearing portions 11*c*, 11*c* are formed integrally with the proximal ends of the left and right rocker arm portions 11*a*, 11*a*. The bearing portions 11*c*, 11*c* are supported with the large-diameter portions 14*a*, 14*a* of the rocker shaft 14. Part of the bearing portions 11*c* towards the rocker arm portions 11*a* are provided with a clearance recess

11*f* that conforms to the outwardly projecting shape of the eccentric pin 14*b*. Thus, the first rocker arm 11 and the rocker shaft 14 can be more efficiently assembled together.

The first control arm 10 is configured such that (i) left and right control-side depressing surfaces 10*b*, 10*b* are formed in an arcuate shape about the center of swing (a) on the lower face of the distal ends of the left and right bifurcated control arm portions 10*a*, 10*a*, (ii) the roller 10*c* in rotational contact with the swing cam surface 9*b* is pivoted between the distal ends of the control arm portions 10*a*, 10*a*, and (iii) a bifurcated, semi-circular bearing portion 10*d* is formed on the proximal ends of the control arm portions. The semi-circular bearing portion 10*d* is rotatably supported with the eccentric pin 14*b* of the rocker shaft 14. A come-off prevention spring 15 prevents the bearing portion and the eccentric pin from coming off.

The come-off prevention spring 15 can be made of spring steel band member, and has a holding portion 15*a* curved into approximately a C-shape and a depressing portion 15*b* that extends from the front end of the holding portion 15*a* toward the distal end of the rocker arm 11. The come-off prevention spring 15 is designed to retain a curved retaining portion 15*c*, which is formed adjacent to the boarder between the holding portion 15*a* and the depressing portion 15*b*, to a retained portion 10*e* of the control arm 10. The come-off prevention spring 15 is also designed to retain an accurate retaining portion 15*d*, which is formed opposite to the pressing portion 15*b*, to the eccentric pin 14*b*. Thereby, the come-off prevention spring 15 holds the bearing portion 10*d* and the eccentric pin 14*b* together for relative rotation while preventing them from separating from each other.

The distal end of the depressing portion 15*b* of the come-off prevention spring 15 comes into contact with a depressing groove 11*e* with a predetermined amount of spring force. In the illustrated embodiment, the depressing groove is provided on the topside of the rocker coupling portion 11*b* of the rocker arm 11 and at the center in the axial direction. The depressing groove 11*e* is formed in an arcuate shape about the center of rotation (a) of the first swing member 9. In the manner as described, the first control arm 10 is urged clockwise as shown in the drawing. The roller 10*c* comes into contact with the swing cam surface 9*b*. A slight gap (d) is created between the rocker-side depressed surface 11*d* and the control-side depressing surface 10*b*.

On the topside of the rocker coupling portion 11*b* of the first rocker arm 11, left and right rocker-side depressed surfaces (first depressed surfaces) 11*d*, 11*d* are formed to come into sliding contact with the left and right control-side depressing surfaces 10*b*, 10*b*. The rocker-side depressed surfaces 11*d*, 11*d* are formed in an arcuate shape of a radius R2 about the center of swing or pivoting motion (a) of the swing shaft 12. An extension line 11*d*' of the arcuate is preferably configured so as to pass in the vicinity of the center of swing (b) of the rocker arm 11, and more preferably, to pass inside a rotation locus C (see FIG. 3) of the axial center (c) of the eccentric pin 14*b*.

The left and right rocker arm portions 11*a*, 11*a* of the first rocker arm 11 have a larger height toward their proximal ends, when viewed from the side (see FIG. 2).

The first rocker arm 11 is thereby rigidly secured. The left and right rocker arm portions 11*a*, 11*a* and the coupling portion 11*b* define a large space. The first control arm 10 is placed to be interposed between the left and right rocker arm portions 11*a*, 11*a* of the first rocker arm 11. A portion of the first control arm 10 on its proximal end side is thus accommodated in the space enclosed by the left and right rocker arm portions 11*a*, 11*a* and the coupling portion 11*b*.

The variable portion is constituted such that rotating the rocker shaft 14 allows a contact point (e) between the roller 10*c* and the swing cam surface 9*b* as well as a contact point (f) between the control-side depressing surface 10*b* and the rocker-side depressed surface 11*d* to continuously vary.

In the variable portion, displacement of the contact point relative to the rotation angle of the rocker shaft 14 in a high operation range in which the opening duration of the intake valve 3 is long and the amount of the valve lift is large (see the roller 10*c* shown by solid lines in FIG. 1) and in a low operation range in which the opening duration of the intake valve 3 is short and the amount of the valve lift is small (see the roller 10*c* shown by chain double-dashed lines in FIG. 1) is smaller than the displacement of the contact point in a medium operation range in which the opening duration of the intake valve 3 and the amount of the valve lift are medium.

In other words, in the high operation range, the axial center of the eccentric pin 14*b* is positioned near (c1), while near (c2) in the low operation range. When the eccentric pin 14*b* is adjacent to (c1) or (c2), each displacement of the contact point (e) and (f) relative to the rotation angle of the rocker shaft 14 is smaller than that in another operation range. In contrast, in the medium operation range, the axial center of the eccentric pin 14*b* is positioned approximately between (c1) and (c2). When the eccentric pin 14*b* is adjacent approximately between (c1) and (c2), each displacement of the contact point (e) and (f) relative to the rotation angle of the rocker shaft 14 is larger than those in the other operation ranges.

An axial end surface 10*f* of the bearing portion 10*d* is in sliding contact with an end surface 14*c* of the large-diameter portion 14*a* of the rocker shaft 14, the end surface forming a step from the eccentric pin 14*b*, thereby positioning the first control arm 10 in the axial direction. In turn, an inner end surface 11*c*' of the bearing portion 11*c* is in sliding contact with an opposite end surface to the end surface 10*f* of the bearing portion 10*d* of the first control arm 10, thereby positioning the rocker arm 11 in the axial direction.

Description will be next made of the operations and effects of this embodiment.

In the valve train device 7 of this embodiment, the rocker shaft driving mechanism controls a rotational angular position of the rocker shaft 14 in accordance with engine operation conditions determined based on the engine speed and load (throttle opening). For example, in a high-speed and high-load operation range, the angular position of the rocker shaft 14 is controlled to position the axial center of the eccentric pin 14 to (c1) as shown by solid lines in FIG. 1. Thus, when the first control arm 10 is positioned at the advanced end and the base circle portion 8*a* of the camshaft 8 comes into contact with the roller 9*d*, the contact point (e) between the roller 10*c* of the first control arm 10 and the swing cam surface 9*b* of the first swing arm 9 is positioned closest to the lift portion 9*f*. This results in maximizing both the opening duration of the intake valve 3 and the amount of valve lift.

In turn, in a low-speed and low-load operation range, the angular position of the rocker shaft 14 is controlled to position the axial center of the eccentric pin 14 to (c2) as shown by chain double-dashed lines in FIG. 1. Thus, the first control arm 10 moves to the retracted end, and the contact point (e) between the roller 10*c* of the first control arm 10 and the swing cam surface 9*b* of the swing member 9 is positioned farthest from the lift portion 9*f*. This results in minimizing both the opening duration of the intake valve 3 and the amount of valve lift.

In this embodiment, when the first control arm 10 and the first swing arm 9 are added to the first rocker arm 11, since the first control arm 10 is located such that its portion on its proximal end side is accommodated in the space defined by the left and right rocker arm portions 11*a*, 11*a* of the first rocker arm 11, and the coupling portion 11*b* coupling the bottom portions of the left and right rocker arm portions 11*a*, 11*a*, an increase in size of the overall device can be restricted, a more compact arrangement is achieved, while still rigidly securing the first rocker arm 11.

In this embodiment, the rocker-side depressed surface 11*d* is formed such that the extension line 11*d*' thereof passes in vicinity of the center of swing (b) of the first rocker arm 11. More preferably, the structure is configure to allow the extension line 11*d*' to pass inside the rotation locus C (see FIG. 3) of the eccentric pin 14. In other words, the first control arm 10 is interposed between the left and right rocker arm portions 11*a*, 11*a* of the first rocker arm 11, and the rocker-side depressed surface 11*d* is formed on the rocker coupling portion 11*b* for coupling the left and right rocker arm portions 11*a*, 11*a*. In this manner, the extension line 11*d*' of the rocker-side depressed surface 11*d* passes in the vicinity of the center of swing (b) of the first rocker arm 11.

The rocker-side depressed surface 11*d* is preferably formed in such a manner that the extension line 11*d*' thereof passes in the vicinity of the center of swing (b) of the rocker arm 11. Thus, the force F transferred from the first swing arm 9 to the contact point (f) via the first control arm 10 can be efficiently transferred to the first rocker arm 11 and therefore to the valve 3. In other words, in this embodiment, since the rocker-side depressed surface 11*d* passes in the vicinity of the center of swing (b) of the first rocker arm 11, the rocker-side depressed surface 11*d* generally agrees with the straight line Lo. This increases a first component force F1 of the force F, the first component force F1 being perpendicular to the straight line Lo as a rotational force of the first rocker arm 11, the force F being transferred from the first control arm 10 to the first rocker arm 11. Thus, the transfer efficiency of the force F from the first control arm 10 to the first rocker arm 11 enhances.

The center of swing (a) of the first swing arm 9 is located at a point opposite to a valve shaft line L1 with respect to a straight line L2 parallel to the valve shaft line L1 and passing the axial center (b) of the rocker shaft 14, while being away from the straight line L2 by (g). This gives advantage to the extension line 11*d*' of the rocker-side depressed surface 11*d* to pass in the vicinity of the center of rotation (b) of the first rocker arm 11. More specifically, as an angle formed between the direction of the force F applied to the first rocker arm 11 and the straight line Lo that connects a point of application of the force F and the center of swing (b) of the first rocker arm 11 is closer to the right angle, the transfer efficiency of the force F increases. Since the center of swing (a) of the first swing arm 9 is located on the side opposite to the valve shaft line L1, the direction of the force F can be easily set to be the direction perpendicular to the straight line Lo.

The eccentric pin 14*b* provided on the midsection of the rocker shaft 14 is adapted to support the bearing portion 10*d* of the control arm portion 10*a* for free rotation, and the come-off prevention spring 15 holds the bearing portion 10*d* and the eccentric pin 14*b*. This allows the opening duration of the valve 3 and the amount of valve lift to continuously change by using a very simple structure or solely rotating the rocker shaft 14. This also facilitates work for coupling the first control arm 10 and the eccentric pin 14*b*.

In the case of multi-cylinder engine, because uniform valve opening duration and amount of valve lift are preferably ensured for all cylinders, several first control arms 10 within the dimensional tolerance range are prepared to be selected in combination with the rocker shaft 14 in order to uniform the valve opening duration and the amount of valve. Assemble and removal work when such a selective combination is required can be easily carried out.

In the illustrated embodiment, the depressing portion 15*b* is integrally formed with the come-off prevention spring 15, the depressing portion 15*b* urging the first control arm 10 by depressing the first rocker arm 11, such that the roller 10*c* comes into contact with the swing cam surface 9*b*. Thus, the roller 10*c* of the first control arm 10 can be constantly in contact with the swing cam surface 9*b* of the first swing arm 9 by a simple constitution. Also, it is possible to constantly have a coating of lubricant between the swing cam surface 9*b* and the roller 10*c*, thereby ensuring lubrication therebetween.

In the illustrated embodiment, offset displacement of the eccentric pin 14*b* is configured such that the outer surface 14*b*' of the eccentric pin 14*b* protrudes outward from the outer surface 14*a*' of the rocker shaft 14 in the radial direction. This can increase the displacement of the first control arm 11 without increasing the diameter of the rocker shaft 14, thereby increasing the adjustment range for the valve opening duration and amount of valve lift.

When the eccentric pin 14*b* protrudes outward, an inner peripheral surface of the bearing portion 11*c* supported with the rocker shaft 14 of the first rocker arm 11 is formed with the clearance recess 11*f* which conforms with the amount of protrusion of the eccentric pin 14*b*. Thus, while the clearance recess 11*f* of the first rocker arm 11 fits the protrusion of the eccentric pin 14*b*, the first rocker arm 11 is displaced in the axial direction of the rocker shaft 14, so that the first rocker arm 11 can be more easily assembled with the rocker shaft 14

In the low operation range in which the opening duration of the valve 3 is short and the amount of valve lift is small, the eccentric pin 14*b* is positioned at (c2) so that the displacement of the contact point (e) relative to the rotation angle of the rocker shaft 14 is smaller than the displacement in the medium operation range in which the opening duration of the valve 3 and the amount of valve lift are medium. This, in the low engine speed range, can avoid abrupt variations in engine output due to slight variations in rotation angle of the rocker shaft 14, and can provide smooth operations, thereby avoiding jerky feeling.

In the high operation range in which the opening duration of the valve 3 is long and so forth, the eccentric pin 14*b* is positioned at (c1), so that the displacement of the contact point (e) relative to the opening angle of the rocker shaft 14 is preset smaller than the displacement in the medium operation range in which the opening duration of the valve is medium and so forth. This, in the high engine speed range, can reduce a torque required for rotating the rocker shaft 14, and can provide smooth driving operations.

The first control arm 10 is brought into sliding contact with the step 14*c* from the eccentric pin 14*b* of the rocker shaft 14, thereby positioning the first control arm in the axial direction. The first rocker arm 11 is brought into sliding contact with the axial end surface 10*f* of the first control arm 10, thereby positioning the first rocker arm in the axial direction. Therefore, positioning of the first control arm 10 and the first rocker arm 11 in the axial direction can be achieved without any dedicated parts.

FIGS. 4 through 7 describe a second embodiment of the invention, in which similar or corresponding parts are denoted by the same reference numerals as in FIGS. 1 through 3.

The driving force transmission mechanism of the valve train device 7 in accordance with the second embodiment of the invention is configured such that a driving force from the intake camshaft 8 swings or pivots a second swing arm 29 through a second control arm 30, the second swing arm 29 swings a second rocker arm 31, and the swinging or pivoting motion of the second rocker arm 31 forces the intake valve 3 to travel back and forth in its axial direction, thereby opening and closing the intake valve opening 2*b*.

The back and forth motion of the second control arm 30 allows a contact point between the second control arm 30 and the second swing arm 29 to continuously vary, which in turn allows a contact point between the second swing arm 29 and the second rocker arm 31 to continuously vary, thereby continuously changing the opening duration of the intake valve 3 and the amount of valve lift.

The second swing arm 29 includes a pair of left and right swing arm portions 29*a*, 29*a* defining sidewalls of the second swing arm 29, and a coupling portion 29*c* defining a bottom wall of the second swing arm 29 and coupling the swing arm portions 29*a*, 29*a*. Proximal ends 29*g*, 29*g* of the pair of left and right swing arm portions 29*a*, 29*a* are swingably or pivotally supported with a swing support shaft 32, which is located parallel to the intake camshaft 8 and is immobile in directions perpendicular to the axis of the swing shaft 32 and in the axial direction thereof. The coupling portion 29*c* couples the lower edges of the pair of left and right swing arm portions 29*a*, 29*a*.

The lower face of the distal end of the coupling portion 29*c* can be formed integrally with a swing cam surface (second swing cam surface) 29*b*. The swing cam surface 29*b* is generally in the shape of a plate having a curved surface in a base circle portion 29*e* and a lift portion 29*f* which are connected to each other continuously. The swing cam surface 29*b* has a similar shape and function to the swing cam surface 9*b* of the first embodiment described above.

In the illustrated embodiment, the second control arm 30 is configured such that a control-side depressing surface (second depressing surface) 30*b* is formed in an arcuate shape on the lower face of the distal ends of the left and right bifurcated control arm portions 30*a*, 30*a*, and a roller 30*c* in rotational contact with the intake camshaft 8 is located between the distal ends of the control arm portions 30*a*, 30*a* and supported with a roller shaft 30*d*. A bifurcated, semi-circular bearing portion 30*d* is formed at the proximal ends of the control arm portions. The bearing portion 30*d* is rotatably supported with an eccentric pin (eccentric shaft) 32*b* of a small diameter, which is formed on the swing shaft 32 to be offset from the center thereof. A come-off prevention spring 15 prevents the bearing portion and the eccentric pin from coming off.

The left and right swing arm portions 29*a*, 29*a* of the second swing arm 29 are formed in the shape of a plate having a large height in the direction of swing, thereby securing the rigidity required for the second swing arm. Since the height of the second swing arm is designed to be large, a large space is defined by the swing arm portions 29*a*, 29*a* and the coupling portion 29*c*. The second control arm 30 is placed to be interposed between the left and right swing arm portions 29*a*, 29*a* of the second swing arm 29. A large part of the second control arm 30 is thereby accommodated in the space enclosed by the left and right swing arm portions 29*a*, 29*a* and the coupling portion 29*c*.

On the topside of the coupling portion 29*c* of the second swing arm 29, left and right swing-arm-side depressed surfaces (second depressed surfaces) 29*d*, 29*d* are formed to come into sliding contact with the left and right control-side depressing surfaces 30*b*, 30*b* of the second control arm 30.

The second swing arm 29 is urged with balance members or springs 33 (e.g., coil springs) such that the roller 30*c* comes into contact with the cam nose 8*c* of the intake camshaft 8. The second swing arm 29 is thereby prevented from moving away from the camshaft 8 at high engine speed. This avoids or reduces abnormal behavior of the swing arm 9.

The second rocker arm 31 is formed with left and right rocker arm portions 31*a*, 31*a*, a rocker coupling portion 31*b*, and ring-shaped bearing portions 31*e*, 31*e*. In the illustrated embodiment, distal ends of the left and right rocker arm portions 31*a*, 31*a* are coupled integrally with the rocker coupling portion 31*b*. The ring-shaped bearing portions 31*e*, 31*e* can be formed integrally with the proximal ends of the left and right rocker arm portions 31*a*, 31*a*. The bearing portions 31*e*, 31*e* are rotatably supported with a rocker shaft 34.

A rocker roller 31*d* defining a second depressed surface is located in the space enclosed by the left and right rocker arm portions 31*a*, 31*a*, the rocker coupling portion 31*b* and the rocker shaft 34, and rotatably supported with a roller shaft 31*c*. The rocker roller 31*d* is constantly in contact with the swing cam surface 29*b*. Opposite ends of the rocker coupling portion 31*b* in the axial direction of the rocker shaft depress the respective top ends of the left and right intake valves 3, 3.

Figure 4:
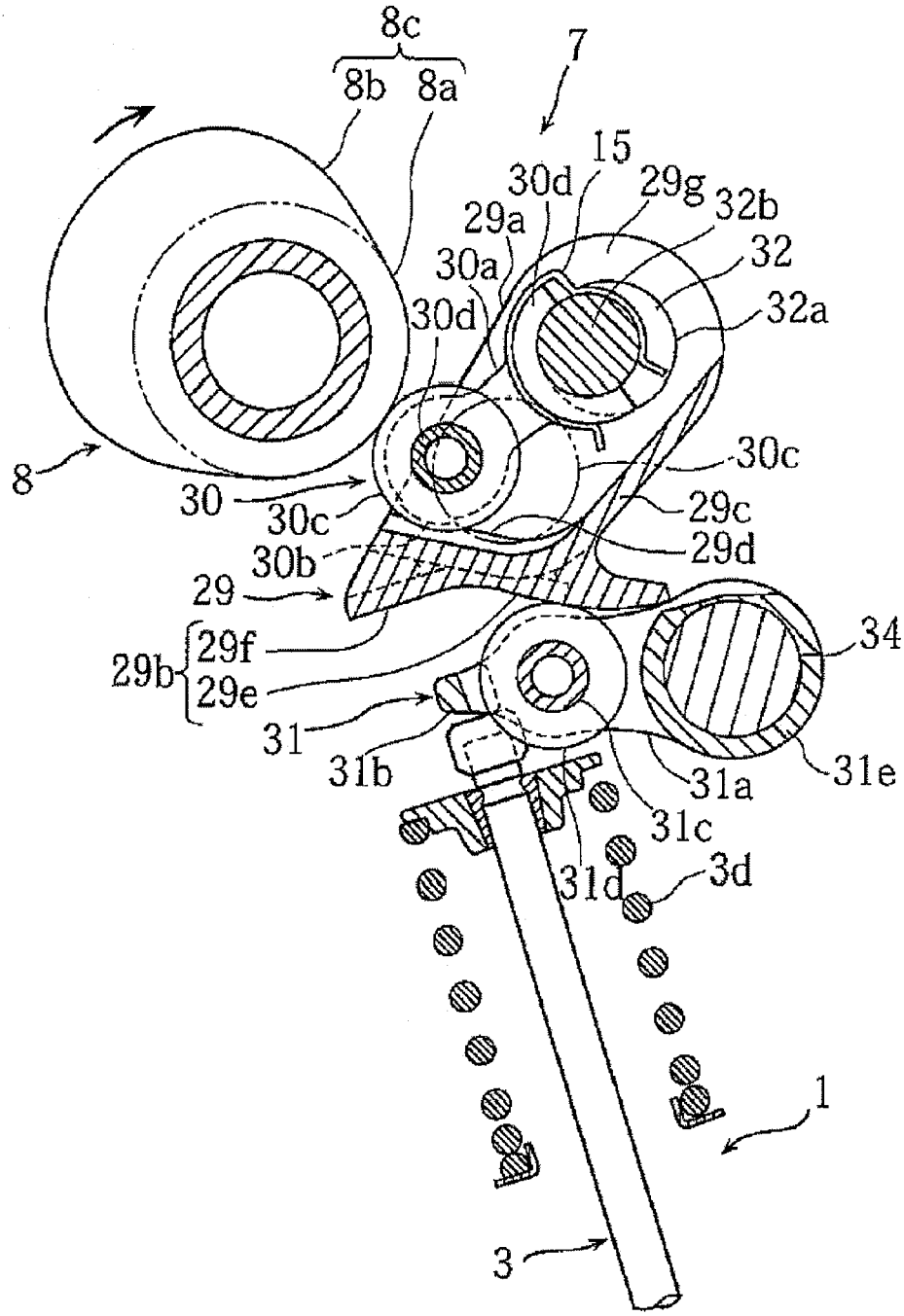
FIG. 4 is a sectional side view of a valve train device for an engine according to a second embodiment of the present invention.
Figure 5:
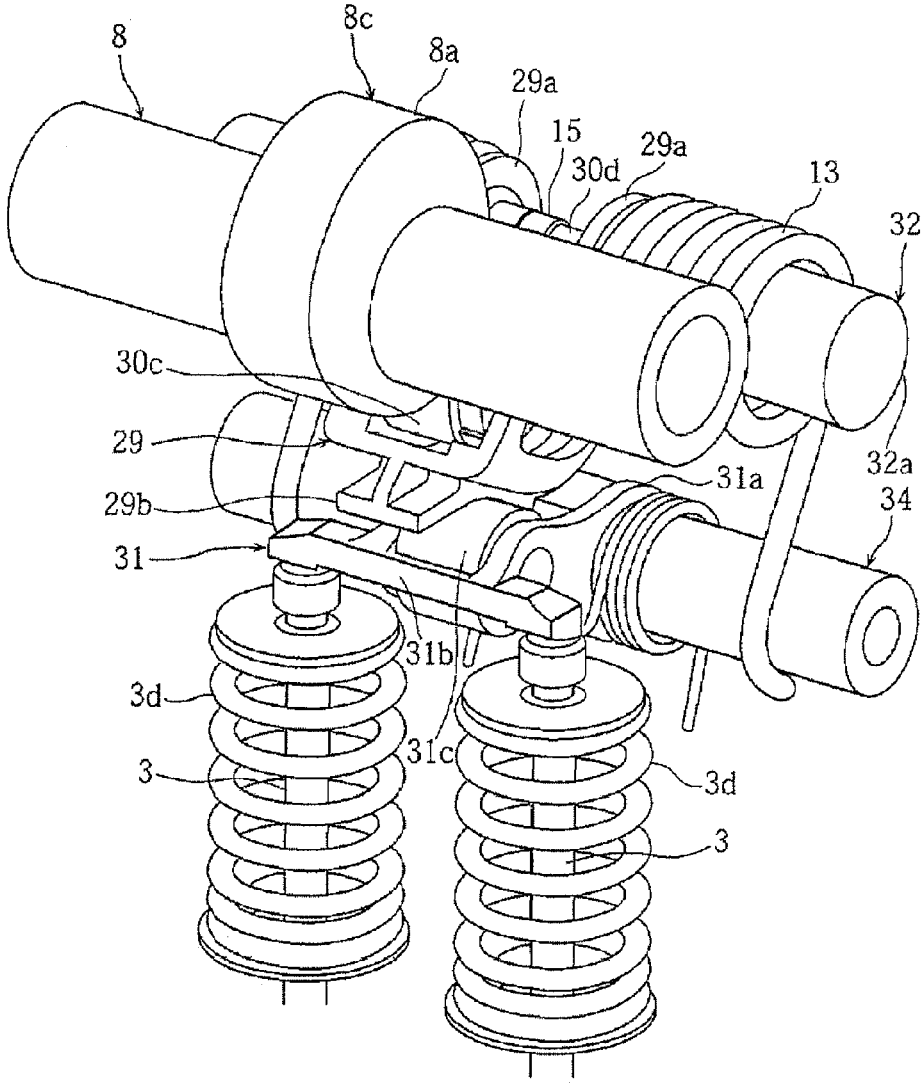
FIG. 5 is a front perspective view of the second embodiment.
Figure 6:
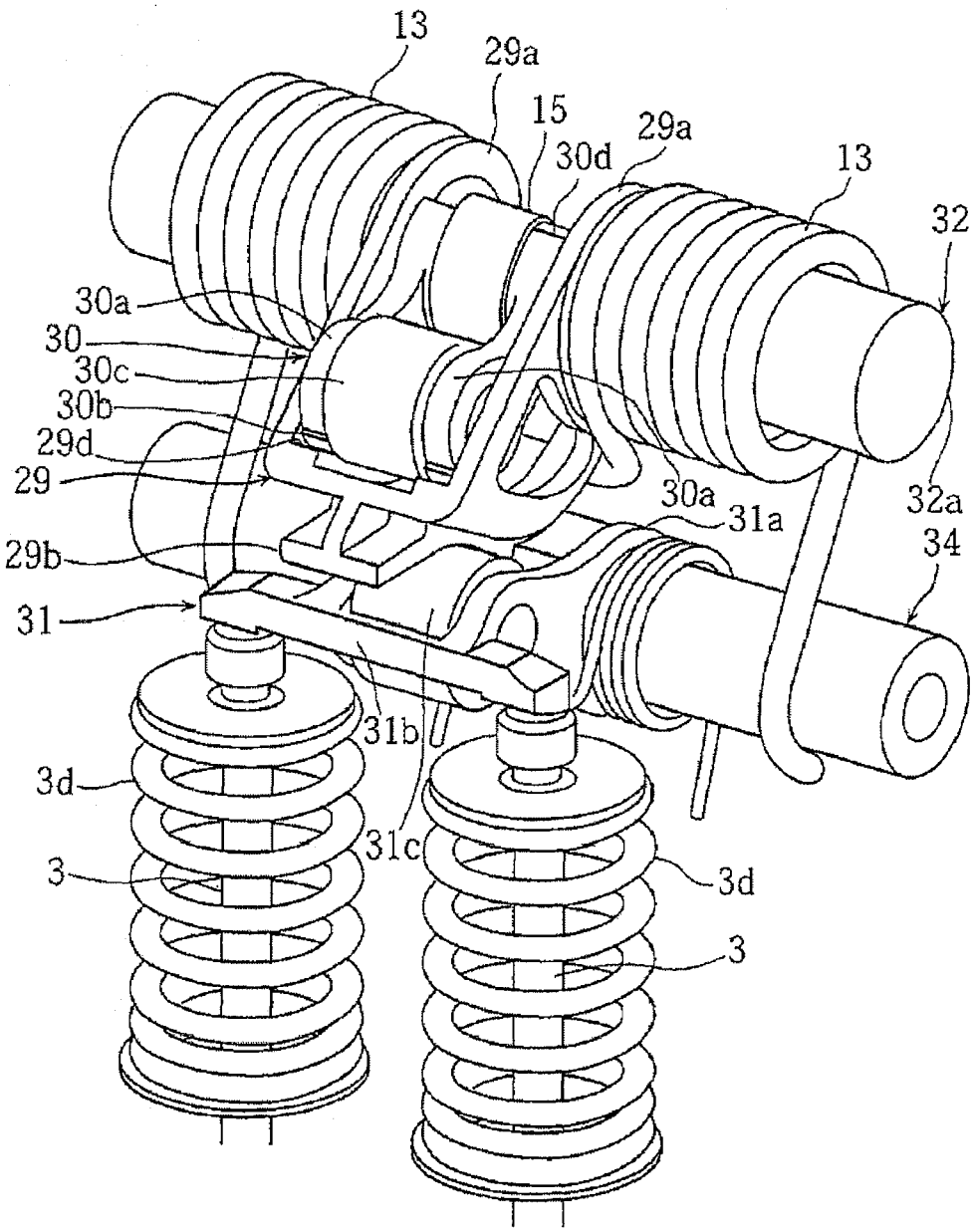
FIG. 6 is a front perspective view of the second embodiment in which a camshaft of the second embodiment is removed.
Figure 7:
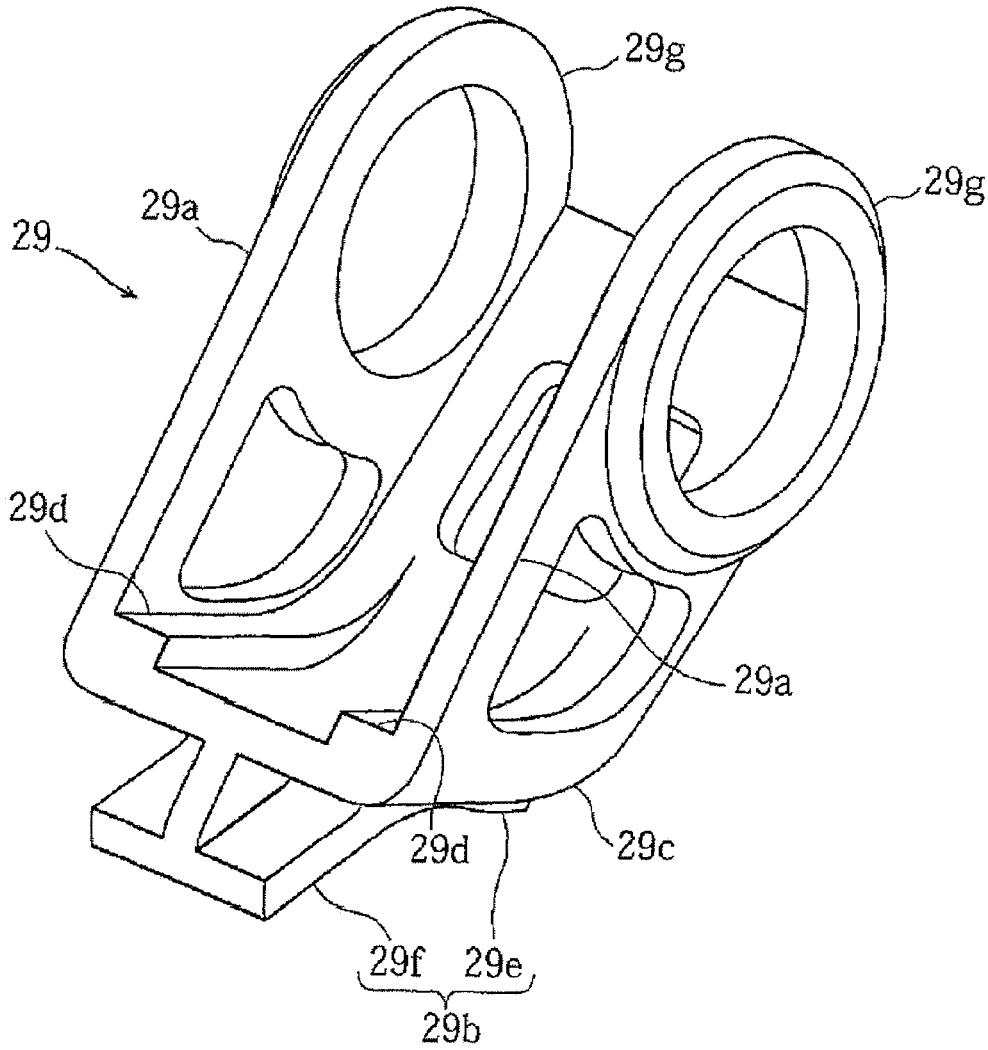
FIG. 7 is a front perspective view of a swing member of the second embodiment.

In the valve train device 7 of the second embodiment, in a high-speed and high-load operation range for example, the angular position of the swing shaft 32 is controlled to position the second control arm 30 at the advanced end as shown by solid lines in FIG. 4. Thus, the second swing arm 29, at the portion of the swing cam surface 29*b* which is closer to the lift portion 29*f* comes into contact with the roller 31*d*. This results in maximizing both the opening duration of the intake valve 3 and the amount of valve lift.

On the other hand, in a low-speed and low-load operation range, the angular position of the swing shaft 32 is controlled to position the second control arm 30 at the retracted end as shown by chain double-dashed lines in FIG. 4. Thus, the second swing arm 29, at the portion of the swing cam surface 29*b*, which is closer to the base portion 29*e* comes into contact with the roller 31*d*. This results in minimizing both the opening duration of the intake valve 3 and the amount of valve lift.

In the second embodiment, when the second control arm 30 and the second swing arm 29 are added to the second rocker arm 31, since the second control arm 30 is located such that its large part is accommodated in the space defined by the left and right swing arm portions 29*a*, 29*a* of the second swing arm 29, and the coupling portion 29*c* coupling the bottom portions of the left and right swing arm portions 29*a*, 29*a*, an increase in size of the overall device can be restricted and a more compact arrangement is achieved while rigidly securing the second swing arm 29.

FIGS. 8 through 12 describe a third embodiment of the invention, in which similar or corresponding parts are denoted by the same reference numerals as in FIGS. 1 through 7.

In this embodiment, the transmitting portion of the driving force transmission mechanism of the valve train device 7 comprises a fixedly located stationary cam 38; a third swing arm 39 in which a roller 39*d* at its distal end comes into contact with the stationary cam 38, a proximal end 39*b* is swingably or pivotally coupled to the third rocker arm 41, and the third swing arm 39 is driven to swing by the intake camshaft (driving member) 8 through a third control arm 40; a third rocker arm 41 in which it is coupled to the swingable third swing arm 39, the proximal end thereof is swingably supported with the rocker shaft 14, and the third rocker arm 41 is driven to swing or pivot by the intake camshaft 8 through the third control arm 40 and the third swing arm 39.

In this embodiment, the variable portion of the driving force transmission mechanism is constituted such that a contact point between the third swing arm 39 and the third control arm 40 interposed between the intake camshaft 8 and the third swing arm 39 is continuously varied, thereby continuously changing the state of a driving force from the intake camshaft 8 being transmitted from the third swing arm 39 to the third rocker arm 41.

A cam surface 38*c* of the stationary cam 38 includes a base circle portion 38*a* and a lift portion 38*b*. The base circle portion 38*a* is formed in an arcuate shape of a radius R3 about the center of a support pin 39*c* of the third swing arm 39. The valve 3 is thus not lifted with an increase of the rotation angle of the intake camshaft 8. On the other hand, the lift portion 38*b* is designed to have a radius of curvature which is gradually reduced as it goes. The lift of the valve 3 is thus increased with an increase of the rotation angle of the intake camshaft 8.

The third rocker arm 41 includes a pair of left and right rocker arm portions 41*a*, 41*a* (see, in particular, FIG. 9) rotatably supported with the rocker shaft 14 and having a generally triangular shape as seen in side view, and a coupling portion 41*b* coupling the rocker arm portions. Ring-shaped bearing portions 41*c*, which are formed at the proximal ends of the rocker arm portions 41*a*, are supported with the rocker shaft 14. Left and right portions of the distal end of the coupling portion 41*b* depress the top end of the intake valve 3. In such a manner, the left and right rocker arm portions 41*a* define walls along a rotational plane of the rocker shaft 14. The left and right rocker arm portions 41*a* have a larger height toward their proximal ends to which a large bending moment is applied, and a smaller height toward their distal ends to which a small bending moment is applied. Also, the rocker arm portions 41*a*, 41*a* are coupled together with the coupling portion 41*b*. The rigidity required for the third rocker arm 41 is thus secured without an unnecessary increase in size.

In the illustrated embodiment, the proximal end of the third control arm 40 is formed integrally with a bearing portion 40*a* that is bifurcated along the direction of holding the rocker shaft 14. The bearing portion 40*a* is swingably or pivotally supported with the eccentric pin 14*b*, which is formed on the rocker shaft 14 and between the left and right rocker arm portions 41*a*, 41*a*. A come-off prevention pin 40*b* prevents the bearing portion and the eccentric pin from coming off.

The distal end of the third control arm 40 can be formed integrally with a support portion 40*f* that is bifurcated along the axial direction of the rocker shaft 14. A roller 40*c* is located between the forks of the support portion 40*f* and supported with a support pin 40*d*. A portion of the outer peripheral face of the support portion 40*f*, on the third swing arm 39 side is formed with a control-side depressing surface 40*e*. The control-side depressing surface 40*e* is in sliding contact with a third depressed surface 39*f* of the third swing arm 39.

A portion of the third control arm 40 on its proximal end side is preferably accommodated in the space defined by the coupling portion 41*b* and the left and right rocker arm portions 41*a*, 41*a* of the third rocker arm 41.

The third swing arm 39 includes left and right swing arm portions 39*a*, 39*a*, and proximal ends 39*b* thereof are coupled for free rotation to a midsection of the third rocker arm 41 with the support pin 39*c*. The roller 39*d* is located between the distal ends of the left and right swing arm portions 39*a* and supported with a support pin 39*e* for free rotation. The roller 39*d* is in rotational contact with the cam surface 38*c* of the stationary cam 38 described above.

Figure 8:
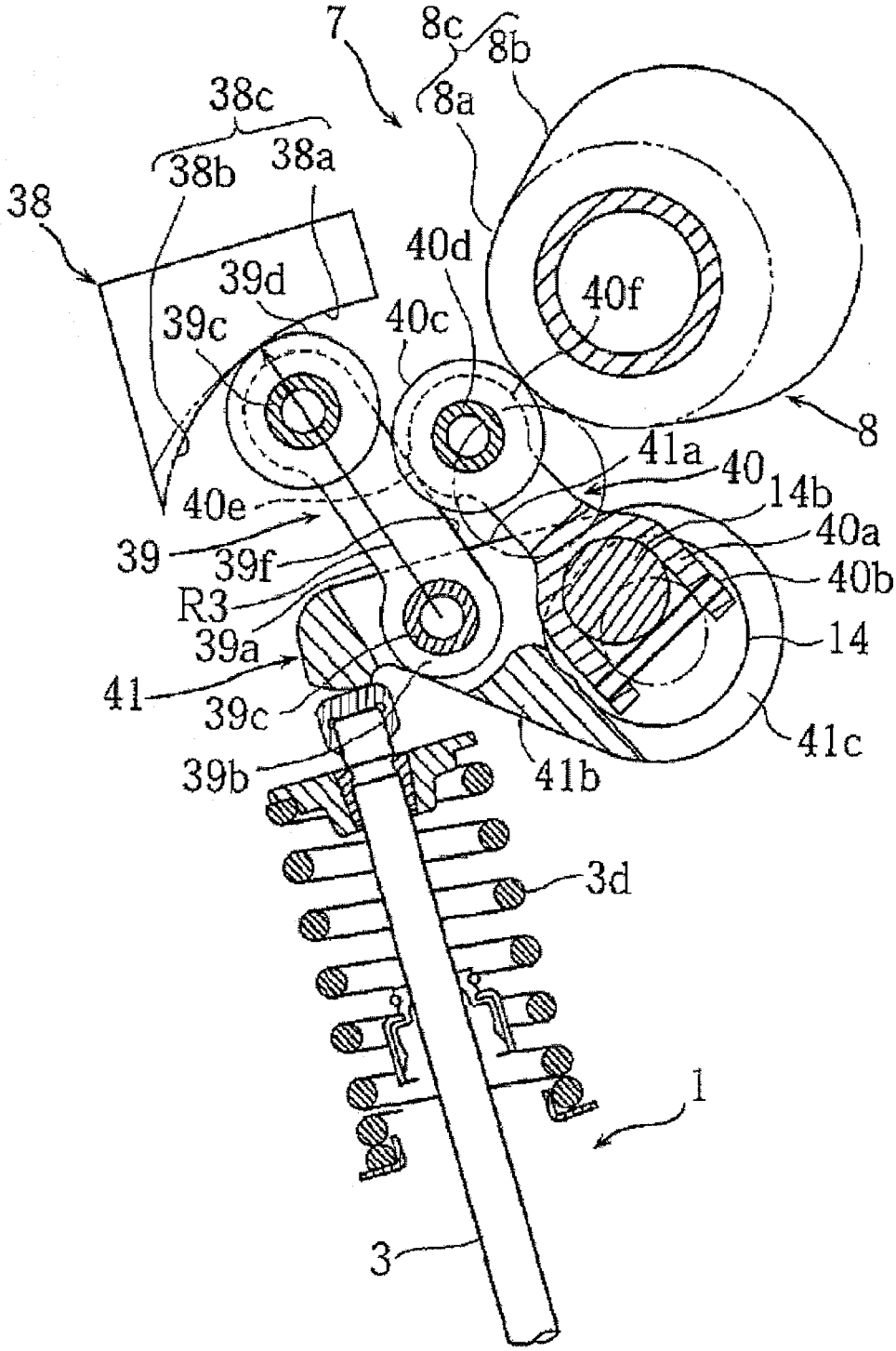
FIG. 8 is a sectional side view of a valve train device for an engine according to a third embodiment of the present invention.
Figure 9:
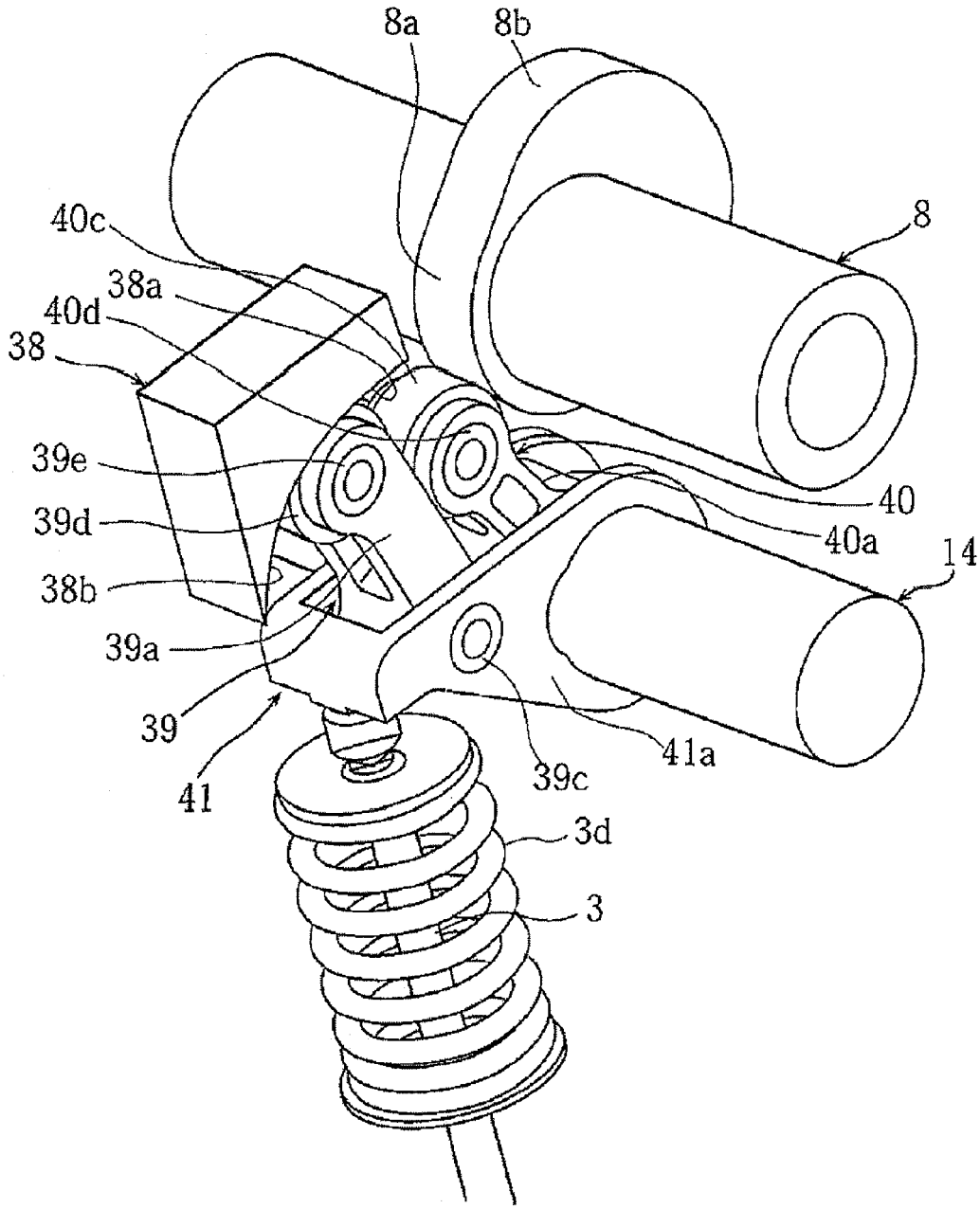
FIG. 9 is a front perspective view of the third embodiment.
Figure 10:
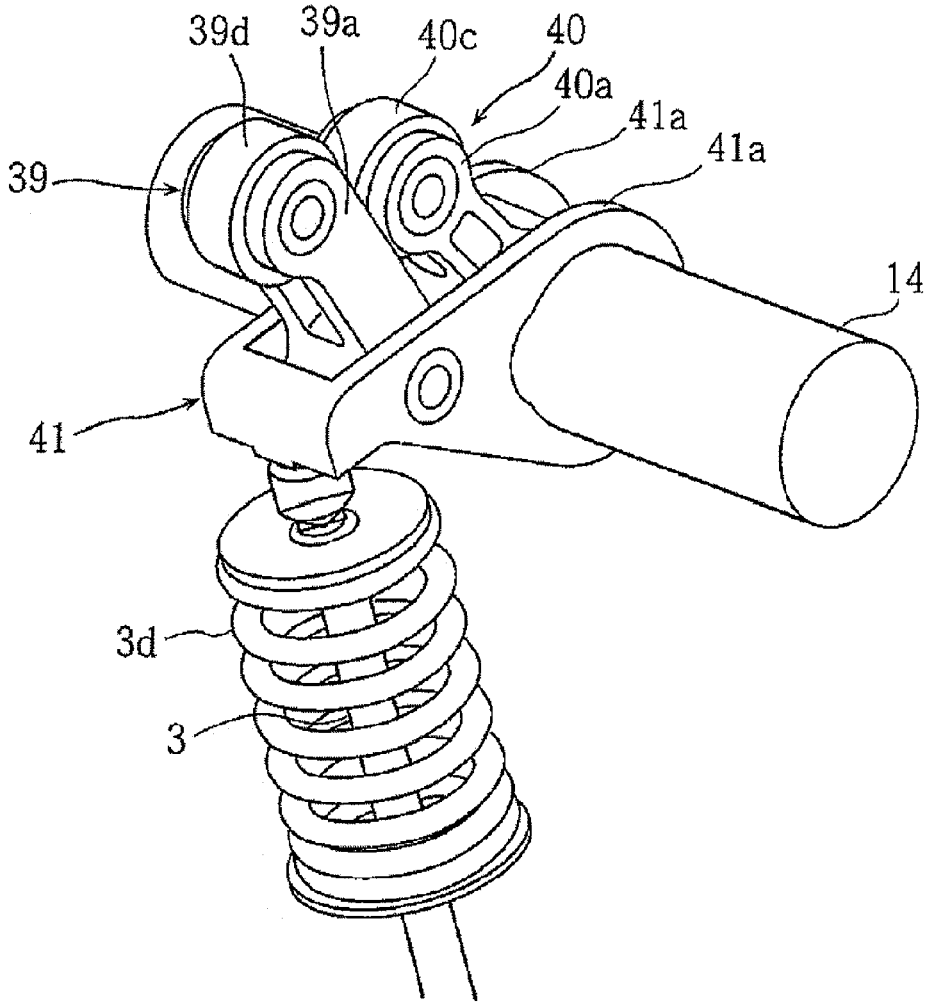
FIG. 10 is a front perspective view of the third embodiment in which a camshaft and stationary cam of the third embodiment are removed.
Figure 11:
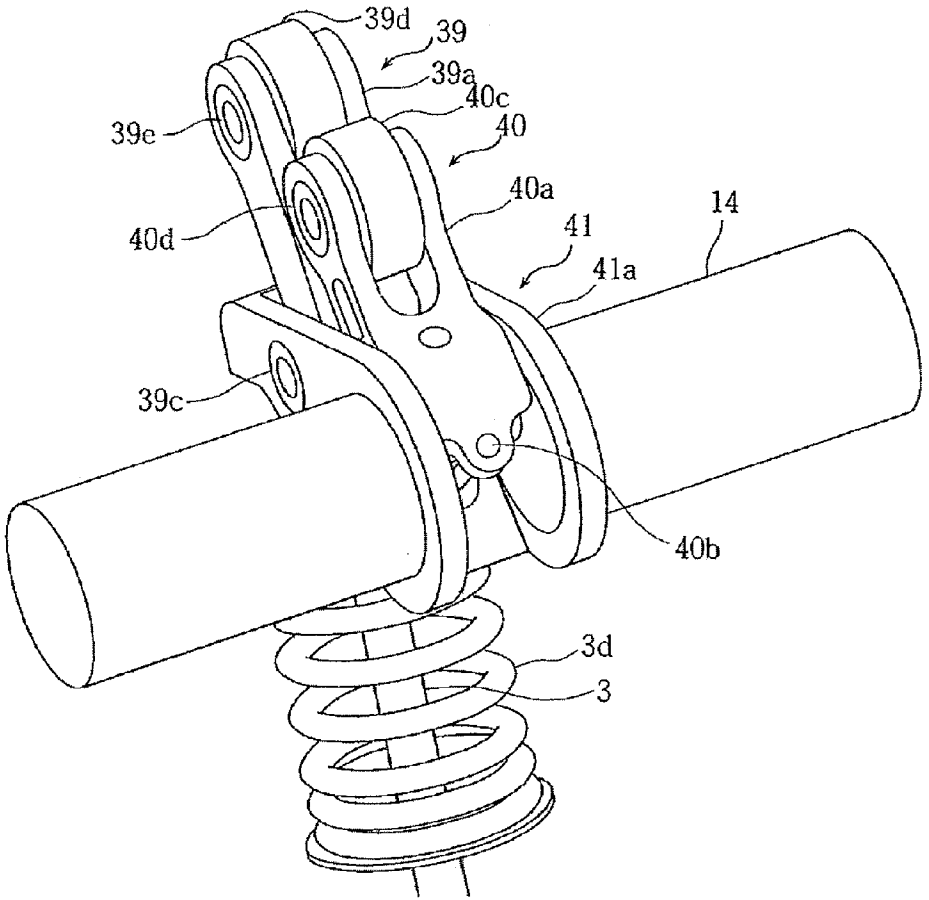
FIG. 11 is a rear perspective view of the third embodiment in which the camshaft and stationary cam of the third embodiment are removed.
Figure 12:
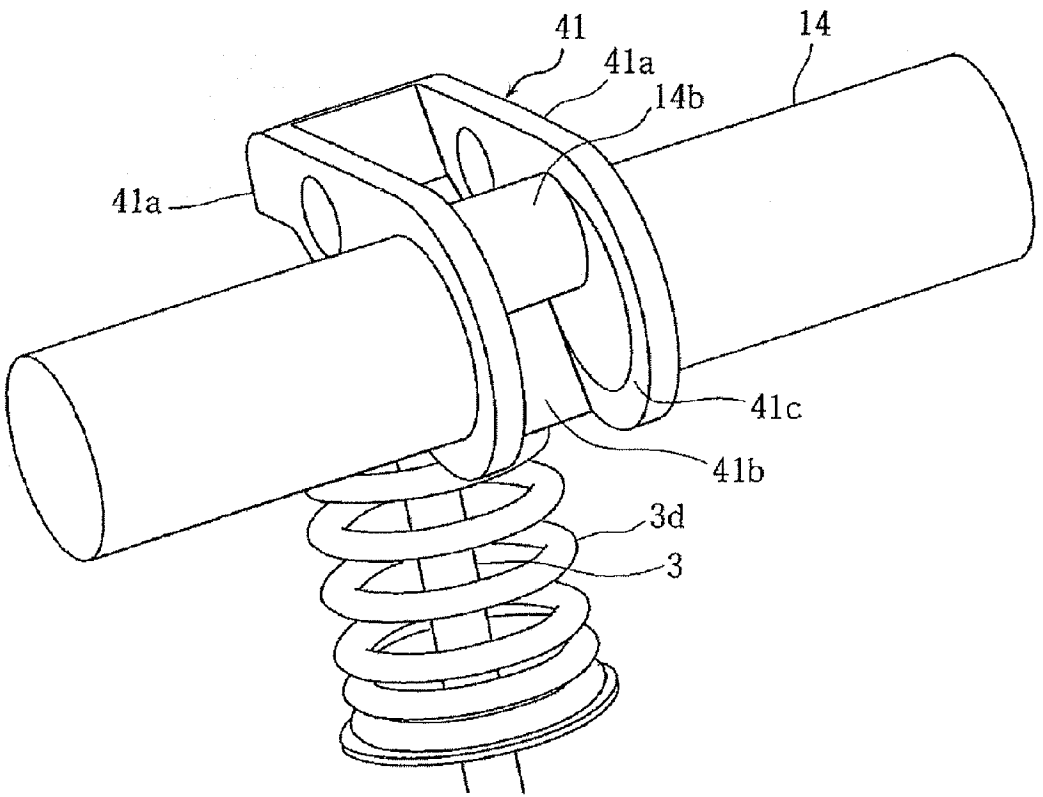
FIG. 12 is a rear perspective view of a rocker arm of the third embodiment.

In a high-speed and high-load operation range, the angular position of the rocker shaft 14 is controlled to move the third control arm 40 to the advanced end as shown by solid lines in FIG. 8. Thus, when the depressing surface 40*e* of the third control arm 40 comes into contact with the distal end of the third swing arm 39 and the base circle portion 8*a* of the intake camshaft 8 comes into contact with the third control arm 40, the roller 39*d* of the third swing arm 39 comes into contact with a portion of the base circle portion 38*a* of the stationary cam surface 38*c* which is closer to the lift portion 38*b*. This results in maximizing the opening duration of the valve and the amount of valve lift.

On the other hand, in a low-speed and low-load operation range, the angular position of the rocker shaft 14 is controlled to position the third control arm 40 at the retracted end, on the contrary to the above. Thus, the roller 39*d* of the third swing arm 39 comes into contact with a portion of the base circle portion 38*a* of the stationary cam surface 38*c* which is farthest from the lift portion 38*b*. This results in minimizing both the opening duration of the intake valve 3 and the amount of valve lift.

In the third embodiment, when the third control arm 40 and the third swing arm 39 are added to the third rocker arm 41, since the third control arm 40 is located such that its portion on its proximal end side is accommodated in the space defined by the left and right rocker arm portions 41*a*, 41*a* of the third rocker arm 41, and the coupling portion 41*b* coupling the bottom portions of the rocker arm portions 41*a*, 41*a*, an increase in size of the overall device can be restricted, providing a compact arrangement, while the rigidly securing the third rocker arm 41.

Figure 13:
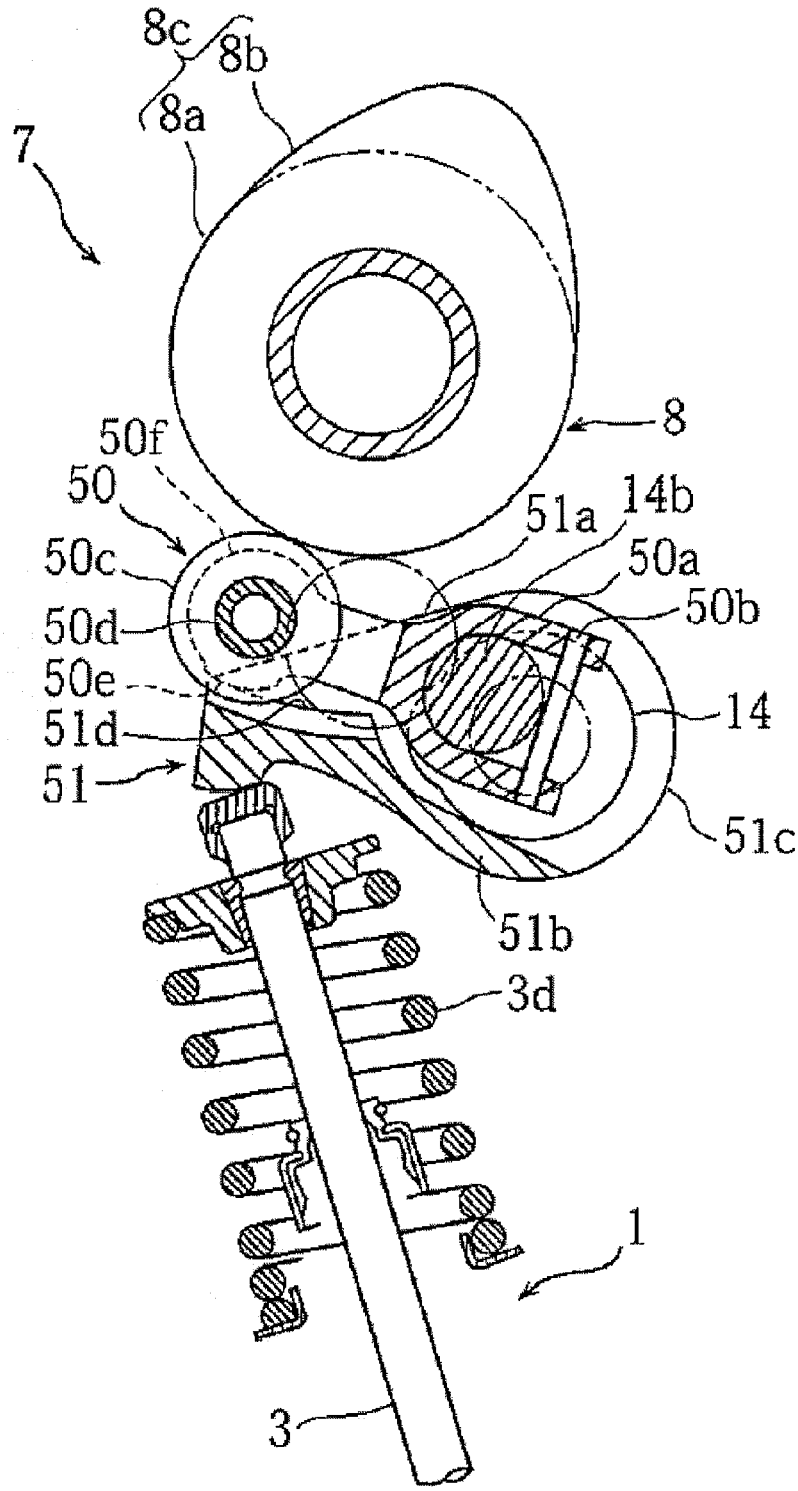
FIG. 13 is a sectional side view of a valve train device for an engine according to a fourth embodiment of the present invention.

FIG. 13 describes a fourth embodiment of the invention, in which similar or corresponding parts are denoted by the same reference numerals as in FIG. 8.

In the fourth embodiment, the transmitting portion of the driving force transmission mechanism includes a fourth rocker arm 51 having a fourth depressed surface 51*d*, swingably supported with the rocker shaft 14, and driven to swing or pivot by the camshaft 8 through a fourth control arm 50.

The variable portion of the driving force transmission mechanism is constituted such that a contact point between the fourth depressed surface 51*d* and the fourth control arm 50 interposed between the camshaft 8 and the fourth rocker arm 51 is continuously varied, thereby continuously changing the state of a driving force being transmitted from the intake camshaft 8 to the fourth rocker arm 51.

The fourth rocker arm 51 includes a pair of left and right rocker arm portions 51*a* supported with the rocker shaft 14, and a coupling portion 51*b* coupling the bottom portions of the rocker arm portions 51*a*. The proximal end of the fourth rocker arm 51 is formed integrally with ring-shaped bearing portions 51*c*. The bearing portions 51*c* are swingably or pivotally supported with the left and right large-diameter portions of the rocker shaft 14.

The proximal end of the fourth control arm 50 is formed integrally with a bearing portion 50*a* bifurcated along the direction to hold the rocker shaft 14. The bearing portion 50*a* is swingably or pivotally supported with the eccentric pin (eccentric shaft) 14*b*, which is formed on the rocker shaft 14 and between the left and right rocker arm portions 51*a*, 51*a*. A come-off prevention pin 50*b* prevents the bearing portion and the eccentric pin from coming off.

The distal end of the fourth control arm 50 is formed integrally with a support portion 50*f* bifurcated along the axial direction of the rocker shaft 14. A roller 50*c* is located between the forks of the support portion 50*f* and supported with a support pin 50*d*. The outer peripheral surface of the support portion 50*f* is formed with a control-side depressing surface 50*e*. The depressing surface 50*e* is in sliding contact with the fourth depressed surface 51*d* of the fourth rocker arm 51.

A portion of the fourth control arm 50 on its proximal end side is accommodated in the space defined by the coupling portion 51*b* and the left and right rocker arm portions 51*a*, 51*a* of the fourth rocker arm 51.

In the fourth embodiment, in a low-speed and low-load operation range, the angular position of the rocker shaft 14 is controlled to position the fourth control arm 50 at the advanced end as shown by solid lines in FIG. 13. A lever ratio of the fourth rocker arm 51 is thereby minimized, resulting in minimizing the amount of valve lift. On the other hand, in a high-speed and high-load operation range, the angular position of the rocker shaft 14 is controlled to position the fourth control arm 50 at the retracted end. The lever ratio of the fourth rocker arm 51 is thereby maximized, resulting in maximizing the amount of valve lift.

In the fourth embodiment, when the fourth control arm 50 is added to the fourth rocker arm 51, since the fourth control arm 50 is located such that its large part is accommodated in the space defined by the left and right rocker arm portions 51*a*, 51*a* of the fourth rocker arm 51, and the coupling portion 51*b* coupling the bottom portions of the rocker arm portions 51*a*, 51*a*, an increase in size of the overall device can be restricted, providing a compact arrangement, while the rigidly securing the fourth rocker arm 51.

Figure 14:
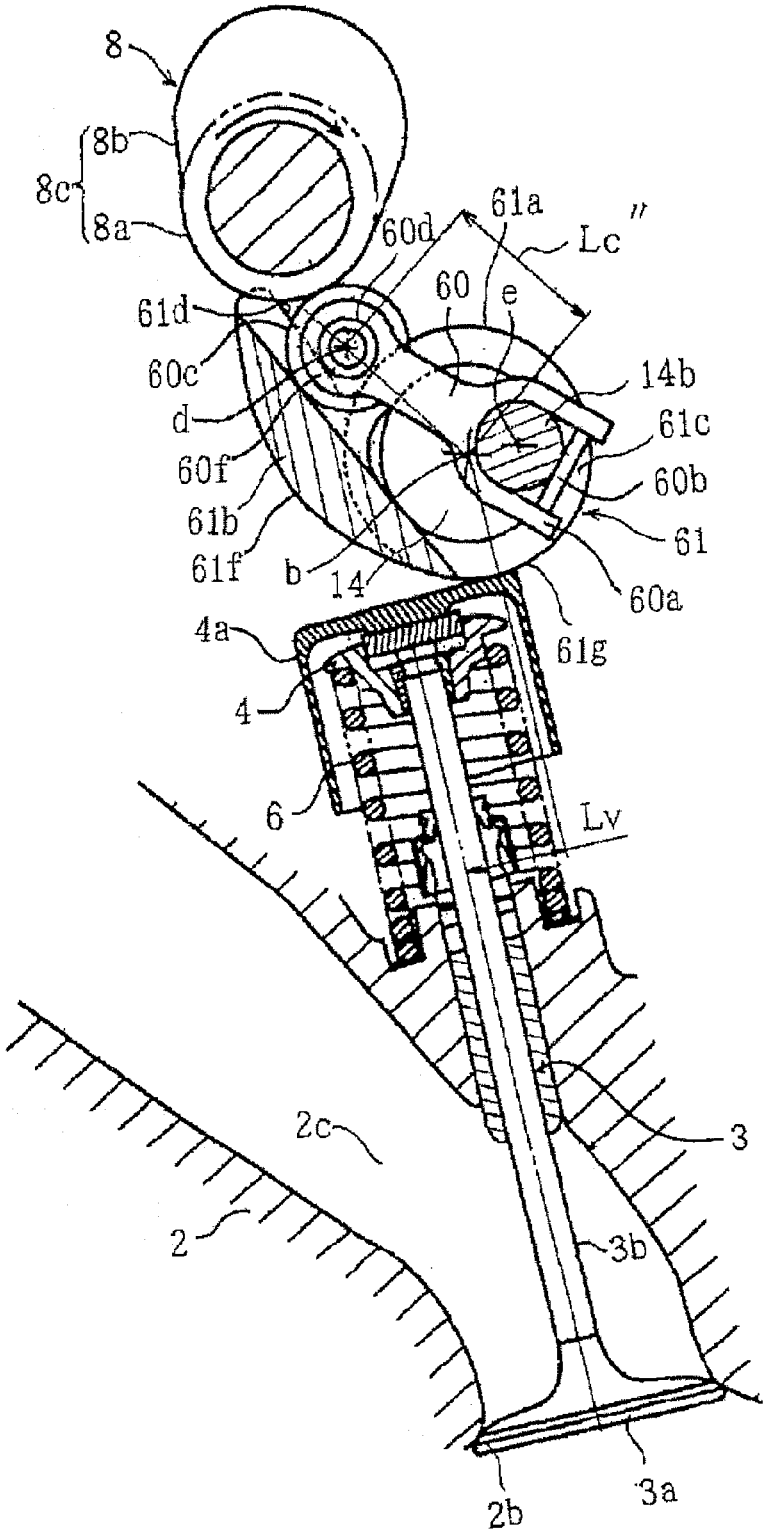
FIG. 14 is a sectional side view of a valve train device for an engine according to a fifth embodiment of the present invention.
Figure 15:
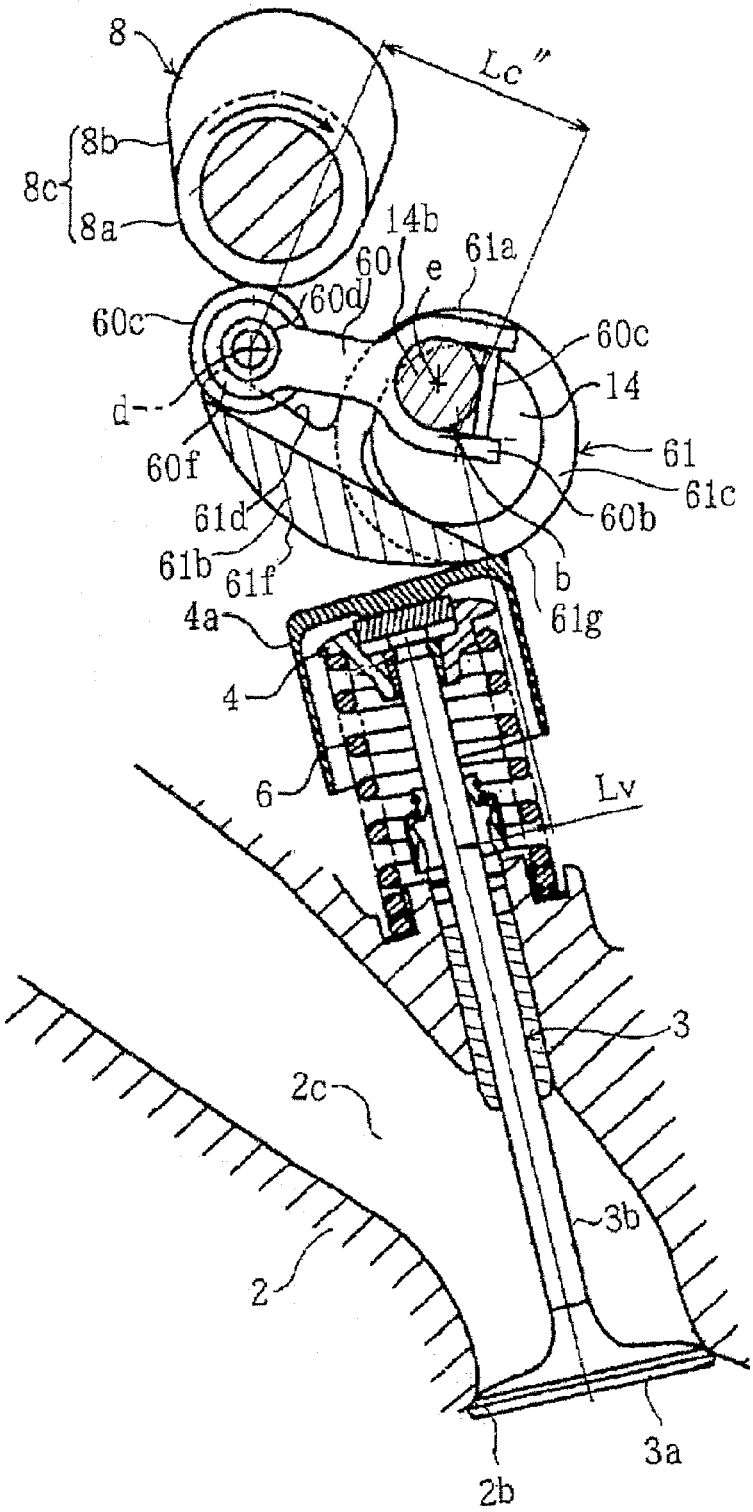
FIG. 15 is a sectional side view of a valve train device for an engine according to the above fifth embodiment.

FIGS. 14 and 15 describe a fifth embodiment of the invention, in which similar or corresponding parts are denoted by the same reference numerals as in FIGS. 1 through 13.

In the fifth embodiment, the transmitting portion of the driving force transmission mechanism includes a fifth rocker arm 61 having a fifth depressed surface 61*d*, swingably or pivotally supported with the rocker shaft 14, and driven to swing by the camshaft 8 through a fifth control arm 60.

The variable portion of the driving force transmission mechanism is constituted such that a contact point between the fifth depressed surface 61*d* and the fifth control arm 60 interposed between the camshaft 8 and the fifth rocker arm 61 is continuously varied, thereby continuously changing the state of a driving force being transmitted from the camshaft 8 to the fifth rocker arm 61.

In this embodiment, the fifth rocker arm 61 includes a pair of left and right rocker arm portions 61*a* supported with the rocker shaft 14, and a coupling portion 61*b* coupling the bottom portions of the rocker arm portions 61*a*. The proximal ends of the left and right rocker arm portions 61*a*, 61*a* can be formed integrally with ring-shaped bearing portions 61*c*. The bearing portions 61*c* are swingably or pivotally supported with the left and right large-diameter portions of the rocker shaft 14.

The fifth rocker arm 61 is formed with a valve lifter depressing surface including a base circle portion 61*g* and a lift portion 61*f*. The base circle portion 61*g* is a concentric circle about the center of swing (b) and does not lift the valve 3 with an increase of the swing angle of the fifth rocker arm 61. The lift portion 61*f* lifts the valve 3 with an increase of the counterclockwise-swing angle of the fifth rocker arm 61 shown in the drawing. The valve lifter depressing surface depresses and drives the valve 3 through a valve lifter 4*a*, which is disposed at the top end of the valve 3.

In the illustrated embodiment, the proximal end of the fifth control arm 60 is formed integrally with a bifurcated bearing portion 60*a*. The bearing portion 60*a* is swingably supported with the eccentric pin (eccentric shaft) 14*b*, which is formed between the left and right large-diameter portions of the rocker shaft 14. A come-off prevention pin 60*b* prevents the bearing portion and the eccentric pin from coming off.

The distal end of the fifth control arm 60 can be formed integrally with a support portion 60*f* bifurcated along the axial direction of the rocker shaft 14. A roller 60*c* is located between the forks of the support portion 60*f* and supported with a support pin 60*d*. Left and right ends of the support pin 60*d* are in sliding contact with the fifth depressed surfaces 61*d* of the fifth rocker arm 61.

A portion of the fifth control arm 60 on its proximal end side is accommodated in the space defined by the coupling portion 61*b* and the left and right rocker arm portions 61*a*, 61*a* of the fifth rocker arm 61.

In the fifth embodiment, in a low-speed and low-load operation range, the angular position of the rocker shaft 14 is controlled to position the fifth control arm 60 at the advanced end as shown in FIG. 15. The lever ratio (Lv/Lc") of the fifth rocker arm 61 is thereby minimized, resulting in minimizing the amount of valve lift. On the other hand, in a high-speed and high-load operation range, the angular position of the rocker shaft 14 is controlled to position the fifth control arm 60 at the retracted end as shown in FIG. 14. The lever ratio of the fifth rocker arm 61 is thereby maximized, resulting in maximizing the amount of valve lift.

According the embodiments described herein, the driving force transmission mechanism includes a transmitting portion and a variable portion. At least part of the variable portion is accommodated within the transmitting portion in accordance with the configurations shown and described above. This decreases the overall size of the valve train device by the volume of portion positioned within the transmitting portion.

According to the embodiment of FIG. 1, the first control arm is interposed between the first swing arm and the first rocker arm, and the contact point between the first control arm and the first swing arm and the contact point between the first control arm and the first rocker arm are allowed to continuously vary. The opening duration of the valve and the amount of valve lift are thereby continuously changed.

In this embodiment, at least part of the first control arm is preferably accommodated in the first rocker arm such that an increase in size of the overall device can be restricted in that the control arm is positioned within the rocker arm.

In the embodiment of FIG. 1, the first rocker arm includes the pair of left and right rocker arm portions supported with the rocker shaft, and the coupling portion for coupling the bottom portions of the rocker arm portions. Since the left and right rocker arm portions define walls along a rotational plane of the first rocker arm, the rigidity of the first rocker arm to a bending moment applied thereto can be significantly increased by the left and right rocker arm portions. Further, the proximal end of the first control arm is accommodated in the space defined by the left and right rocker arm portions and the coupling portion. Thus, the left and right rocker arm portions provided to secure the rigidity of the first rocker arm are effectively used to accommodate the proximal end of the first control arm, thereby restricting an increase in size of the overall device in the case of adding the first control arm and the first swing arm to the first rocker arm.

According to the embodiment of FIG. 4, the second control arm is interposed between the second swing arm and the camshaft, and the contact point between the second control arm and the second swing arm is allowed to continuously vary. Also, at least part of the second control arm is preferably accommodated in the second swing arm. Thus, the opening duration of the valve and the amount of valve lift are continuously changed, and also an increase in size of the overall device is restricted.

In embodiment of FIG. 4, the second swing arm includes the pair of left and right swing arm portions supported with the swing shaft, and the coupling portion coupling the bottom portions of the swing arm portions. Since the left and right swing arm portions define walls along a rotational plane of the second rocker arm, the rigidity of the second swing arm to a bending moment applied thereto can be significantly increased by the left and right swing arm portions. Further, the proximal end of the second control arm is accommodated in the space defined by the left and right swing arm portions and the coupling portion. Thus, the left and right swing arm portions provided to secure the rigidity of the second swing arm are effectively used to accommodate the proximal end of the second control arm, thereby restricting an increase in size of the overall device in the case of adding the second control arm and the second swing arm to the second rocker arm.

According to the embodiment of FIG. 8, the third control arm is interposed between the camshaft and the third swing arm having the proximal end coupled to the third rocker arm and the distal end comes into contact with the stationary cam, and the contact point between the third control arm and the third swing arm is allowed to continuously vary. Also, at least part of the third control arm is accommodated in the third rocker arm. Thus, the opening duration of the valve and the amount of valve lift are continuously changed, and also an increase in size of the overall device can be restricted.

According to the embodiment of FIG. 8, since the third rocker arm includes the pair of left and right rocker arm portions supported with the rocker shaft, and the coupling portion coupling the rocker arm portions, the rigidity of the third rocker arm to a bending moment applied thereto can be significantly increased by the left and right rocker arm portions. Further, the proximal end of the third control arm is accommodated in the space defined by the left and right rocker arm portions and the coupling portion. Thus, the left and right rocker arm portions provided to secure the rigidity of the third rocker arm are effectively used to accommodate the proximal end of the third control arm, thereby restricting an increase in size of the overall device in the case of adding the third control arm and the third swing arm to the third rocker arm.

According to certain embodiments described above, the control arm is interposed between the rocker arm and the driving member, and the contact point between the control arm and the rocker arm is allowed to continuously vary. Also, at least part of the control arm is accommodated in the rocker arm. Thus, the opening duration of the valve and the amount of valve lift are continuously changed, and also an increase in size of the overall device can be restricted.

According to certain embodiments described above, the rocker arm includes the pair of left and right rocker arm portions, and the coupling portion coupling the bottom portions of the rocker arm portions, and the proximal end of the control arm is accommodated in the space defined by the left and right rocker arm portions and the coupling portion. Thus, an increase in size of the overall device can be restricted.

Also, the rigidity of the rocker arm to a bending moment applied thereto can be significantly increased by the left and right rocker arm portions. Further, the proximal end of the control arm is accommodated in the space defined by the left and right rocker arm portions and the coupling portion. Thus, the left and right rocker arm portions provided to secure the rigidity of the rocker arm are effectively used to accommodate the proximal end of the control arm, thereby restricting an increase in size of the overall device in the case of adding the control arm to the rocker arm.

In the embodiment of FIG. 14, when the fifth control arm 60 is added to the fifth rocker arm 61, since the fifth control arm 60 is located such that its large part is accommodated in the space defined by the left and right rocker arm portions 61*a*, 61*a* of the fifth rocker arm 61, and the coupling portion 61*b* coupling the bottom portions of the rocker arm portions 61*a*, 61*a*, an increase in size of the overall device can be restricted, while the the fifth rocker arm 61 is rigidly secured.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combine with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A valve train device for an engine for driving a valve which opens and closes a valve opening of a combustion chamber, comprising:

a valve drive device comprising a drive member;

a drive force transmission mechanism configured to transmit a driving force from the drive member to the valve, the drive force transmission mechanism comprising a transmission portion configured to transmit the driving force from the drive member to the valve and a variable portion configured to continuously change a state of the transmission portion to thereby continuously change an opening duration of the valve or the amount of valve lift, wherein at least part of the variable portion is positioned within in the transmission portion;

wherein the state of the transmission portion is changed by changing the position of the variable portion with respect to the transmission portion; and wherein the transmission portion includes an arm comprising a pair of bearing portions that are pivotally supported on a support shaft;

wherein the variable portion comprises a control arm that is pivotally supported on an eccentric shaft which is formed on the support shaft between the pair of bearing portions.

2. A valve train device for an engine for driving a valve which opens and closes a valve opening of a combustion chamber, comprising:

a valve drive device comprising a drive member;

a drive force transmission mechanism configured to transmit a driving force from the drive member to the valve, the drive force transmission mechanism comprising a transmission portion configured to transmit the driving force from the drive member to the valve and a variable portion configured to continuously change a state of the transmission portion to thereby continuously change an opening duration of the valve or the amount of valve lift, wherein at least part of the variable portion is positioned within in the transmission portion;

wherein the transmission portion includes a swing arm having a swing cam surface, the swing arm being supported for pivoting movement about a swing arm support shaft, the swing arm being driven to pivot by the drive member and the transmission portion comprises a rocker arm that is supported for pivoting movement about a rocker arm support shaft; and wherein the variable portion comprises a control arm that is supported for pivoting movement by the rocker arm support shaft and wherein the rocker arm has a recessed surface and the rocker arm is pivoted by the swing cam surface through the control arm, which is interposed between the rocker arm and the swing arm, the opening duration of the valve or the amount of valve lift being determined by the shape of the swing cam surface.

3. The valve train device according to claim 2, wherein the variable portion is configured to allow a contact point between the control arm and the swing cam surface and another contact point between the control arm and the recessed surface to continuously vary to thereby continuously change the state of the driving force from the drive member being transmitted from the first swing arm to the first rocker arm.

4. The valve train device according to claim 3, wherein at least a portion of the control arm is positioned within the first rocker arm.

5. The valve train device according to claim 4, wherein the rocker arm includes left and right rocker arm portions supported on the rocker arm support shaft, a coupling portion for coupling the rocker arm portions together, the coupling portion being located on a lower side of the left and right rocker arm portions, and wherein a proximal end of the control arm is pivotally supported on an eccentric shaft which is formed on the rocker support shaft between the left and right rocker arm portions, and wherein a portion of the control arm on its proximal end side is positioned, at least partially, in a space defined by the coupling portion and the left and right rocker arm portions.

6. A valve train device for an engine for driving a valve which opens and closes a valve opening of a combustion chamber, comprising:

a valve drive device comprising a drive member;

a drive force transmission mechanism configured to transmit a driving force from the drive member to the valve, the drive force transmission mechanism comprising a transmission portion configured to transmit the driving force from the drive member to the valve and a variable portion configured to continuously change a state of the transmission portion to thereby continuously change an opening duration of the valve or the amount of valve lift, wherein at least part of the variable portion is positioned within in the transmission portion;

wherein the transmission portion includes a swing arm that is pivotally supported on a swing arm support shaft, the swing arm forming a swing cam surface and wherein the variable portion comprises a control arm that is pivotally supported on the swing arm support shaft; and wherein the swing arm is driven by the drive member through the control arm, which is interposed between the drive member and the swing arm and wherein the variable portion allows a contact point between the control arm and the swing arm to be continuously varied, thereby continuously changing the state of the driving force from the drive member being transmitted from the swing arm to the rocker arm and wherein at least part of the control arm is positioned within lateral edges of the swing arm.

7. The valve train device according to claim 6, wherein the swing arm includes left and right swing arm portions supported by swing arm support shaft; and a coupling portion for coupling bottom portions of the left and right swing arm portions, wherein a proximal end of the control arm is swingably supported by an eccentric shaft which is formed on the swing arm support shaft and positioned between the left and right swing arm portions, and wherein a portion of the second control arm on its proximal end side is accommodated in a space defined by the coupling portion and the left and right swing arm portions.

8. A valve train device for an engine for driving a valve which opens and closes a valve opening of a combustion chamber, comprising:

a valve drive device comprising a drive member;

a drive force transmission mechanism configured to transmit a driving force from the drive member to the valve, the drive force transmission mechanism comprising a transmission portion configured to transmit the driving force from the drive member to the valve and a variable portion configured to continuously change a state of the transmission portion to thereby continuously change an opening duration of the valve or the amount of valve lift, wherein at least part of the variable portion is positioned within in the transmission portion; and wherein the transmission portion includes a cam surface positioned on a stationary cam, a swing arm which has a distal end that comes into contact with the cam surface and driven to pivot about an axis by the drive member through a control arm that is interposed between the drive member and swing arm; and a rocker arm that coupled to a proximal end of the swing arm, the rocker arm having a proximal end that pivots on a rocker arm support axis, the rocker arm driven to pivot by the drive member through the control arm and the swing arm, and wherein the variable portion is configured to allow a contact point between the third control arm and the third swing arm to continuously vary, thereby continuously changing the state of the driving force from the drive member being transmitted from the third swing arm to the third rocker arm, and wherein at least part of the third control arm is positioned within the lateral sides of the third rocker arm.

9. The valve train device according to claim 8, wherein the rocker arm includes left and right rocker arm portions that are supported pm the rocker arm support shaft; and a coupling portion for coupling the rocker arm portions, and wherein the proximal end of the control arm is swingably supported on an eccentric shaft which is formed on the rocker arm support shaft and is positioned between the left and right rocker arm portions, and a portion of the control arm on its proximal end side is accommodated in a space defined by the coupling portion and the left and right rocker arm portions.

10. A valve train device for an engine for driving a valve which opens and closes a valve opening of a combustion chamber, comprising:

a valve drive device comprising a drive member;

a drive force transmission mechanism configured to transmit a driving force from the drive member to the valve, the drive force transmission mechanism comprising a transmission portion configured to transmit the driving force from the drive member to the valve and a variable portion configured to continuously change a state of the transmission portion to thereby continuously change an opening duration of the valve or the amount of valve lift, wherein at least part of the variable portion is positioned within in the transmission portion; and wherein the transmission portion includes a rocker arm having a contact surface and being pivotally supported on a rocker arm support shaft and driven to pivot by the drive member through a control arm interposed between the drive member and the rocker arm, and wherein the variable portion is configured to allow a contact point between the control arm and the contact surface to continuously vary, thereby continuously changing the state of the driving force being transmitted from the drive member to the rocker arm, and wherein at least part of the control arm is positioned within the lateral sides of the rocker arm.

11. The valve train device for an engine according to claim 10, wherein the rocker arm includes left and right rocker arm portions supported on the rocker arm support shaft; and a coupling portion for coupling bottom portions of the left and right rocker arm portions, and wherein a proximal end of the control arm is pivotally supported on an eccentric shaft which is formed on the rocker arm support shaft and between the left and right rocker arm portions, and at least a portion of the control arm on its proximal end side is positioned within in the space defined by the coupling portion and the left and right rocker arm portions.

12. A valve train device for an engine for driving a valve which opens and closes a valve opening of a combustion chamber, comprising:

a valve drive device comprising a drive member;

a drive force transmission mechanism configured to transmit a driving force from the drive member to the valve, the drive force transmission mechanism comprising a transmission portion configured to transmit the driving force from the drive member to the valve and a variable portion configured to continuously change a state of the transmission portion to thereby continuously change an opening duration of the valve or the amount of valve lift, wherein at least part of the variable portion is positioned within in the transmission portion; and wherein the transmission portion includes a pivoting rocker arm and having a first surface and a second surface configured to depress a valve lifter which is attached to the valve, wherein the rocker arm is driven to pivot by the drive member through a control arm interposed between the first surface of the rocker arm and the drive member, and wherein the variable portion is configured to allow a contact point between the control arm and the first surface to continuously vary, thereby continuously changing the state of the driving force being transmitted from the drive member to the rocker arm, and wherein at least part of the control arm is positioned within in with the lateral sides of the rocker arm.

13. The valve train device according to claim 12, wherein the rocker arm includes left and right rocker arm portions supported on a rocker arm support shaft; and a coupling portion for coupling bottom portions of the left and right rocker arm portions, and wherein a proximal end of the control arm is pivotally supported on an eccentric shaft that is formed on the rocker arm support shaft and is positioned between the left and right rocker arm portions, and a portion of the control arm on its proximal end side is positioned in a space defined between the coupling portion and the left and right rocker arm portions.

* * * * *